US007610686B1

(12) United States Patent
Summers et al.

(10) Patent No.: US 7,610,686 B1
(45) Date of Patent: Nov. 3, 2009

(54) SUPPORTING BOWSIGHTS

(75) Inventors: Gregory E. Summers, P.O. Box 498, Madison Heights, VA (US) 24572; Daniel Edward Ellgass, Big Island, VA (US)

(73) Assignee: Gregory E. Summers, Madison Heights, VA (US)

( * ) Notice: Subject to any disclaimer, the term of this patent is extended or adjusted under 35 U.S.C. 154(b) by 157 days.

(21) Appl. No.: 11/860,607

(22) Filed: Sep. 25, 2007

Related U.S. Application Data

(60) Provisional application No. 60/880,280, filed on Jan. 13, 2007.

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | | |
|---|---|---|---|---|---|
| 2,893,124 | A * | 7/1959 | Sundquist | 33/265 |
| 3,284,904 | A * | 11/1966 | Rade | 33/265 |
| 4,020,560 | A | 5/1977 | Heck | |
| 4,495,705 | A | 1/1985 | Kowalski et al. | |
| 4,584,777 | A | 4/1986 | Saunders | |
| 4,616,623 | A * | 10/1986 | Williams | 124/87 |
| 4,986,001 | A * | 1/1991 | Giamattei | 33/265 |
| 5,092,053 | A | 3/1992 | Roberts | |
| 5,384,966 | A | 1/1995 | Gibbs | |
| 5,414,936 | A * | 5/1995 | Sappington | 33/265 |
| 5,428,901 | A * | 7/1995 | Slates | 33/265 |
| 5,507,272 | A * | 4/1996 | Scantlen | 124/87 |
| 5,722,175 | A * | 3/1998 | Slates | 33/265 |
| RE36,266 | E | 8/1999 | Gibbs | |
| 6,446,347 | B1 | 9/2002 | Springer | |
| 6,508,005 | B2 | 1/2003 | Springer | |
| 7,086,161 | B2 * | 8/2006 | Ellig et al. | 33/265 |
| 7,287,335 | B2 * | 10/2007 | Yasuda et al. | 33/265 |
| 7,484,303 | B1 * | 2/2009 | Henry | 33/265 |
| 2006/0201005 | A1 * | 9/2006 | Lueck | 33/265 |

OTHER PUBLICATIONS

"Shibuya Products—Sight," printed from www.shibuya-archery.com on Oct. 30, 2006, 11 pages.

Stanislawski Archery Products brochure, 1974 Desert Inn Classic, 8 pages.

* cited by examiner

*Primary Examiner*—Christopher W Fulton
(74) *Attorney, Agent, or Firm*—Leading-Edge Law Group, PLC; Matthew R. Osenga; James T. Beran

(57) ABSTRACT

A device can include a support structure to be supported on a bow and that, through other structures and components, can support a viewing part such as an archery sight. For example, the support structure and a structure movable in an elevation direction can have paired guide surfaces that slide against each other, with opposite sets of guide surfaces having effective spans within a stable range despite a user pressing on one side, as in coarse adjustment. Guide surface shapes can allow only negligible relative movement, as with V-shapes. Gibs can be on guide surfaces, with some gibs adjustable to compensate wear, such as with springs. Also, a structure movable in a windage direction can have tapered bushings around guide pins that extend through them and can receive pressure from a spring-like component such as a spring wave washer. And a removable scope mounting device can have parts allowing adjustment around two axes.

29 Claims, 22 Drawing Sheets

SUPPORTING BOWSIGHTS

This application claims the benefit of U.S. Provisional Patent Application No. 60/880,280, filed Jan. 13, 2007, entitled "Supporting Bowsights", incorporated herein by reference in its entirety.

BACKGROUND OF THE INVENTION

The present invention relates generally to sights used by archers, and more specifically to techniques for archers to support sights on bows.

Many techniques have been proposed for supporting sights on bows. Examples of such techniques are disclosed, for example, in U.S. Pat. Nos. 4,020,560; 4,495,705; 4,584,777; 5,092,053; 6,446,347; 6,508,005; and Re. 36,266.

It would be advantageous to have improved techniques relating to archery sights.

SUMMARY OF THE INVENTION

The invention provides various exemplary embodiments, including systems, apparatus, devices, products and methods. In general, the embodiments are implemented in relation to support of archery sights on bows.

These and other features and advantages of exemplary embodiments of the invention are described below with reference to the accompanying drawings.

DETAILED DESCRIPTION

Figure 1:
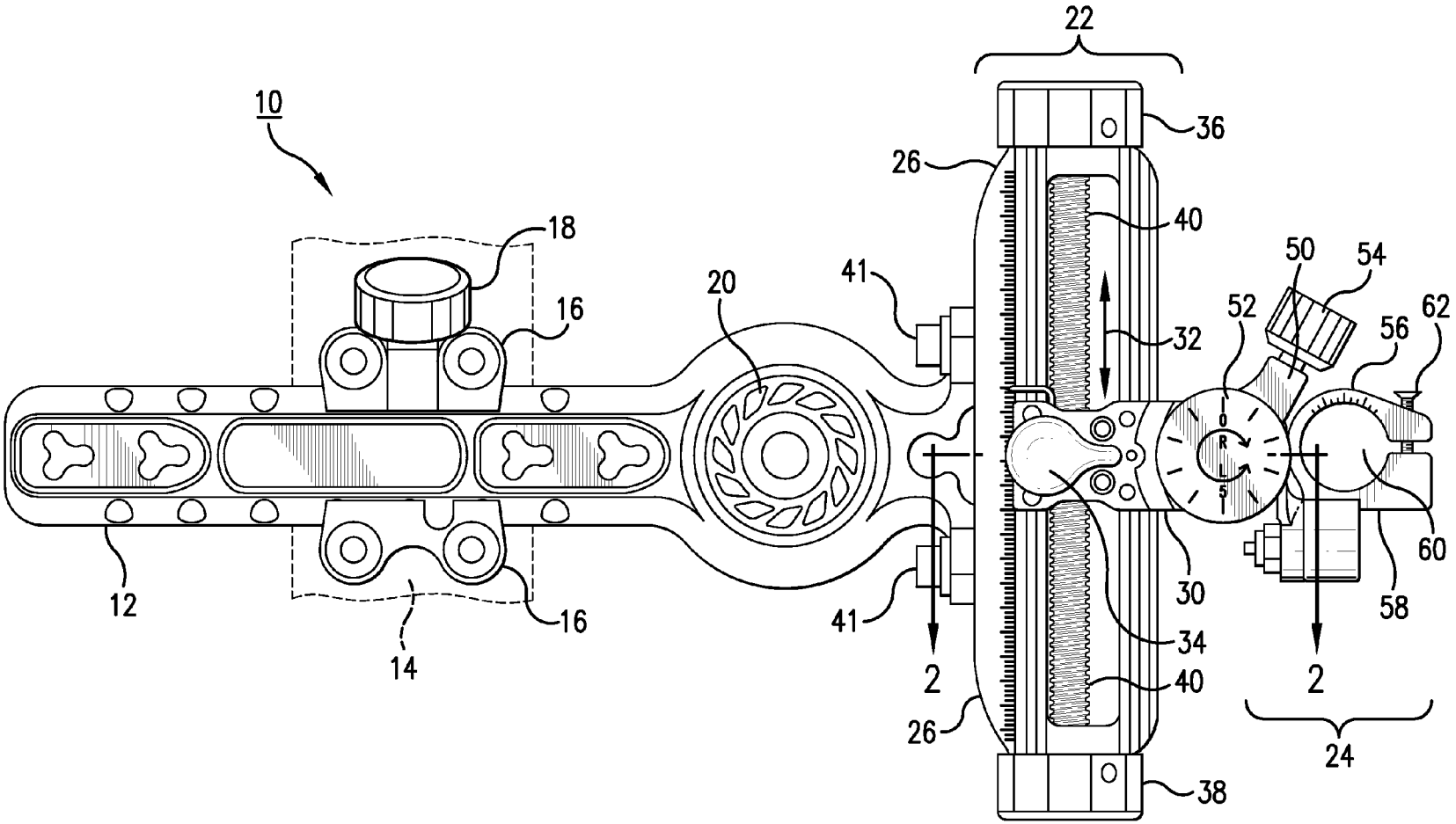
FIG. 1 is a side view of an archery sight system that includes an elevation component and a scope mounting component.

In the following detailed description, numeric values and ranges are provided for various aspects of the implementations described. These values and ranges are to be treated as examples only, and are not intended to limit the scope of the claims. In addition, a number of materials are identified as suitable for various facets of the implementations. These materials are to be treated as exemplary, and are not intended to limit the scope of the claims.

The term "archery sight" (or simply "bowsight" or "sight") is used herein to mean a product used by an archer holding a bow and arrow to visually aim the arrow toward a target before releasing the arrow from the bow. Many archery sights include a "scope", meaning an optical component through which an archer can view a target; a scope could, for example, be a telescope-like magnifying component. Scopes, pin sights, and other such components through or past which an archer can view and aim at a target are sometimes referred to herein as "viewing parts". Viewing parts are typically supported on bows, and the term "archery sight" is used herein to refer not only to viewing parts by themselves but also to structures that can be used to support a scope or other viewing part on a bow and, where appropriate, to combinations of viewing parts with such supporting structures.

The implementations described below address problems that arise with supporting archery sights on bows. Once an archery sight is supported somehow on a bow, various adjustments are necessary. For example, an archer will adjust the position of the sight when shooting at targets at different distances; also, the archer will adjust the sight's position as wind speed or direction changes; furthermore, when an archer installs a new sight, various adjustments will be necessary to obtain the best position of the sight. These adjustments must be made often enough that wear can occur on parts of a structure supporting a sight such as due to repeated sliding of parts against each other or other mechanical effects. As a result of wear and other structural features, the support for an archery sight can become sloppy or loose, making it impossible to obtain a precise, consistent adjustment. At the same time, some of the adjustments available are difficult to make, such as because they cannot be made quickly or they cannot be made precisely. These and related problems often operate together to prevent an archer from performing at his or her best.

In general, the implementations described below involve combinations of parts or components. As used herein, a "system" is a combination of two or more parts or components that together can operate as a whole. One component of an archery sight system can, for example, be a "scope mounting component" on which a scope, bowsight, or other viewing part can be mounted. Other parts or components can perform other operations, such as a "control component" that controls an adjustment or other operation; a "sliding component" that slides; a "spring-like component" that is a spring or that operates like a spring; an "elevation component" that operates to provide movement in an elevation direction as described below; a "pressure-responsive part" that responds to pressure; a "guide part" that operates to guide another part or component; a "bushing part" that operates as a bushing; and a "mounting part" that operates to allow mounting of a scope, bowsight, other viewing part, or some other part or component. In addition, some parts or components are described in relation to structural features, such as a "pin-like part" that is shaped similarly to a pin.

In the implementations described below, apparatus, systems, or parts or components of apparatus or systems are referred to as "attached" to each other or to other apparatus, systems, parts, or components or vice versa, and operations are performed that "attach" apparatus, systems, or parts or components of apparatus or systems to each other or to other things or vice versa; the terms "attached", "attach", and related terms refer to any type of connecting that could be performed in the context. One type of attaching is "mounting", which occurs when a first part or component is attached to a second part or component that functions as a support for the first. In contrast, the more generic term "connecting" includes not only "attaching" and "mounting", but also making other types of connections such as between or among parts formed as a single piece of material by molding or other fabrication, in which case connected parts are sometimes referred to as "integrally formed".

A combination of one or more parts connected in any way is sometimes referred to herein as a "structure". Similarly to a component, a structure may be described by its operation, such as a "support structure" that can operate as a support, a "scope housing structure" that can operate to hold a scope, bowsight, or other viewing part, an "elevation structure" that can move in an elevation direction as described below, a "windage structure" that can move in a windage direction as described below, or a "fastening structure" or "fastener" that can fasten other parts or components. Some structures are also described by structural features.

FIG. 1 shows system 10, an implementation of an archery sight system. System 10 includes bar 12, an elongated part that can be attached to an archer's bow as suggested by the dashed-line outline of bow 14 and by bracket 16, which can be attached to bow 14 by screws or similar fasteners and can be tightened by turning nylon-tipped lock knob 18 to hold bar 12 in position on bow 14.

When mounted on bow 14 for use, bar 12 extends away from the archer, such as toward a target, and holds a number of other components of system 10 that assist the archer in reliably aiming at targets by using a "bowsight", used herein to refer to any of various structures, devices, and other viewing parts through which an archer who is shooting an arrow with a bow can look to aim the arrow at a target. To assist an archer, archery sight system 10 provides several components, each of which allows adjustment of the bowsight's position or orientation. Between bar 12 and the other components is illustratively vibration absorbing component 20, an optional component that can be implemented with a commercially available part such as a Mathews Harmonic Damper from Mathews Inc., including a rubber housing and a weight mounted in the rubber housing. In the illustrated implementation, bar 12 can be approximately 6 inches long (6.562 inches in one successful implementation), but bars of several convenient lengths could be available for each archer to choose, such as 6, 9, and 12 inches, and each size could be available with or without component 20.

The remaining parts of system 10 in front of component 20 include elevation component 22 and scope mounting component 24. Implementations of components 22 and 24 are described in greater detail below, but some general features can be understood from FIG. 1.

Elevation component 22 includes frame 26, part of a support structure mounted on bar 12 that supports block 30. Like bar 12, frame 26 could be available in different lengths for each archer to choose, such as 4 inches as illustrated or 5.5 inches. Frame 26 can, for example, be metal, machined to include various holes and other features described below, as well as holes for connection to bar 12.

An elevation structure that includes block 30 and several other parts of component 22 is supported on the support structure but can move upward and downward relative to frame 26 in the directions indicated by bi-directional arrows 32. These upward and downward directions are referred to herein as "elevation directions", because they determine the upward and downward position of a bowsight or other viewing part mounted on scope mounting component 24. Because of its role in making adjustments in elevation directions, block 30 is referred to herein as an "elevation block".

An archery sight system with elevation component 22 as illustrated in FIG. 1 provides a framework of orientation that can be described as follows: The center of the framework of orientation can be the area in which a bar or other part of the archery sight system is attached to the bow, illustrated in FIG. 1 where bar 12 is connected to bow 14; the directions set forth below are referred to in the same way, however, when the bow is in other positions than that shown or even when the archery sight system is detached from the bow. A direction from this center of orientation toward the archer is referred to as "backward", "rearward", "behind", and so forth, while directions from the center of orientation toward a target are referred to as "forward", "in front", or the like. When the archer is holding the bow upright, one of the directions indicated by arrows 32 will be toward the ground, and this direction is referred to as "down", "downward" or the like, while the opposite direction is referred to as "up", "upward" or the like. Also, directions perpendicular both to the forward-backward direction and to the upward-downward direction can be referred to as "leftward" and "rightward" according to the archer's position, and a direction away from a central plane of the bow leftward or rightward can be referred to as "outward", while a direction toward a central plane of the bow can be referred to as "inward".

In the implementation in FIG. 1, the elevation structure that includes block 30 operates to move upward and downward in response either to coarse adjustments made by pressing button 34 and exerting upward or downward pressure or to fine adjustments made by turning either of knobs 36 and 38. Knobs 36 and 38 are connected to the ends of threaded rod 40, and inward-facing threads (not shown) engage rod 40 as it turns, causing the elevation structure to move upward and downward relative to frame 26. Frame 26 is in turn attached to bar 12 such as by screws 41 or other appropriate fasteners, so that upward and downward movement of the elevation structure can be used to adjust the position of a bowsight for different distances between bow 14 and a target, as indicated by pointer 42 with reference to position markings on frame 26. Additional details about coarse adjustment using button 34 are set forth below.

In the example shown in FIG. 1 and described at greater length below, frame 26 illustratively surrounds the opening in which rod 40 extends, but frame 26 could take a variety of shapes, in some of which it would not completely surround the opening. Similarly, rod 40 might be implemented in other ways to make a fine adjustment in the elevation direction, although the use of a threaded rod as shown provides extremely simple and stable fine adjustment.

Scope mounting component 24 could similarly be implemented in many ways, some of which are described below. Block 30 supports another block referred to as a "windage block", of which part 50 is shown extending from behind knob 52 in FIG. 1. Knob 52 can be turned to adjust the position of a windage structure that includes the windage block in a lateral direction, moving it either leftward by turning counterclockwise or rightward by turning clockwise, as indicated by markings on knob 52, such as with a decal. This lateral direction is described herein as a "windage direction" because an adjustment of the windage structure's position is typically made to account for wind conditions. In addition, the windage block supports the parts of scope mounting component 24, which are held in place by lock screw 54 as described in greater detail below. In the illustrated implementation, scope mounting component 24 includes clamp arms 56 and 58 around opening 60. A bowsight, sometimes referred to herein as a "scope", can be held in a cylindrical mounting part as described below, which extends through opening 60 and is held firmly in place when screw 62 is tightened through arms 56 and 58.

Figure 2:
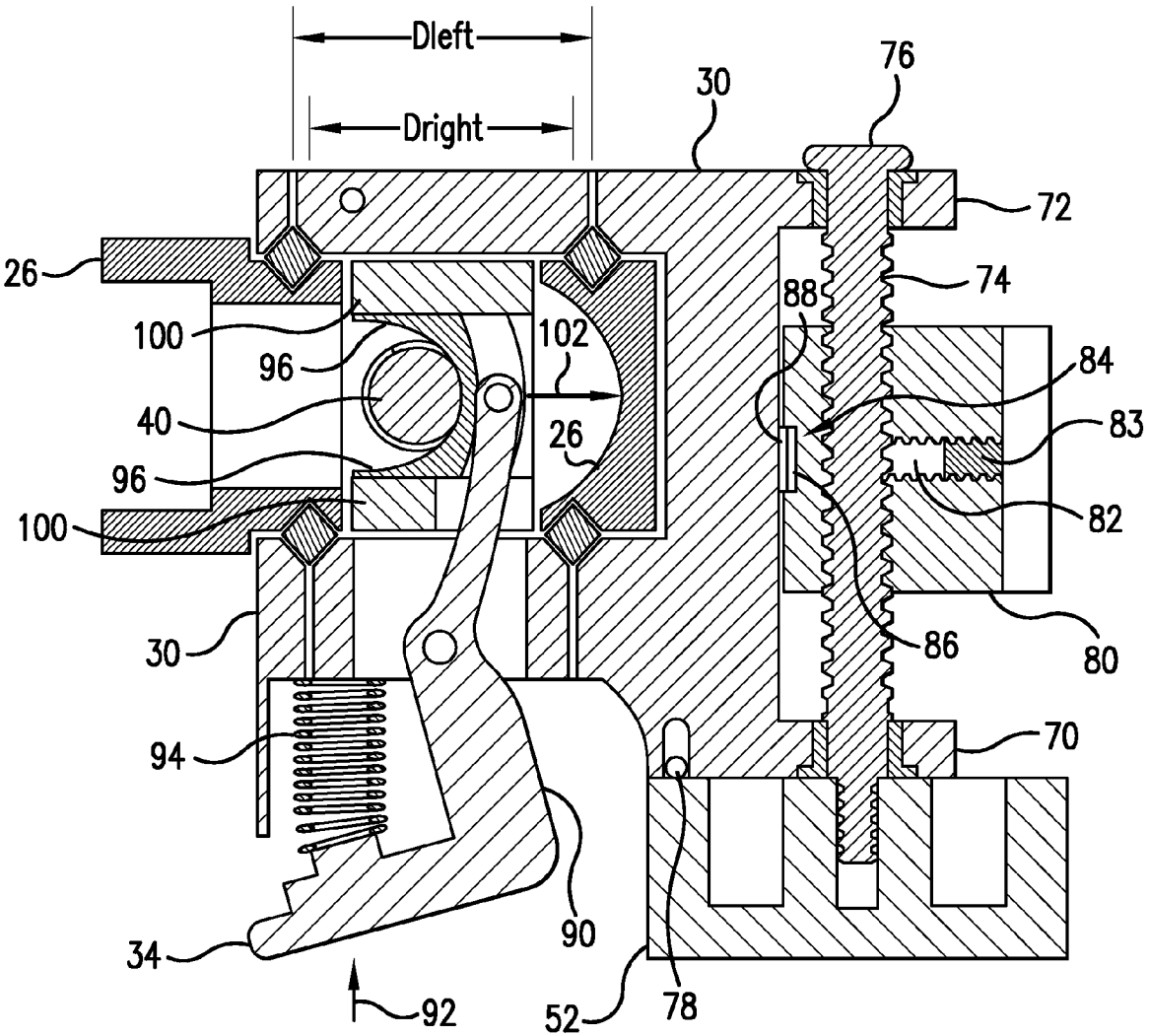
FIG. 2 is a cross-sectional view of an archery sight system, taken along the line 2-2 in FIG. 1.

FIG. 2 shows features of frame 26 and the elevation structure that includes block 30, in cross section. As shown, elevation block 30 fits around frame 26 on the forward side. Extending forward on block 30, away from frame 26, are arms 70 and 72, through which extends screw 74, with knob 52 attached to one end and with the other end secured by screw head 76. Spring-biased ball bearing 78 in a hole in arm 70 engages grooves on knob 52 to provide clicks as knob 52 turns, as described below. Screw 74 could be implemented, for example, with a 10-32 screw of an appropriate length.

Windage block 80 has a threaded central bore that fits around screw 74, so that windage block 80 moves leftward or rightward when knob 52 is turned. To allow lubrication, threaded hole 82 is formed in windage block 80, and can have screw 83 inserted in it to keep it closed except when screw 74 is being lubricated through it.

In addition, to prevent windage block 80 from becoming loose on its support, recess 84 can hold a set of washers or the like between windage block 80 and the facing surface of elevation block 30. In a successful implementation, the set includes wave spring washer 86 against windage block 80 and nylon washer 88 between wave spring washer 86 and elevation block 30. Although wave spring washer 86 is spring-like, it is sufficiently thin when squeezed between windage block 80 and nylon washer 88 that nylon washer 88 is also held within recess 84, eliminating noise and wear as windage block 80 moves from side to side across elevation block 30. Meanwhile, wave spring washer 86 provides substantially constant biasing pressure against windage block 80, as described below.

Additional features of windage block 80 are described below in relation to implementations of scope mounting component 24.

Elevation block 30 is supported on frame 26 at four positions, as described in greater detail below in relation to FIG. 3. The distances between the effective center lines of the two pairs of support positions are illustrated as Dright and Dleft in FIG. 2. As can be seen, Dright is slightly smaller than Dleft, and its projection illustratively fits within the positions of Dleft, so that it is within a stable range relative to Dleft: in a successful implementation, Dright is 1/32 inch less than Dleft, but it is believed that a difference as small as 0.001 inch would suffice if the end positions were within a stable range. More generally, Dright is an effective span across which the support positions on the left side (at the top side in FIG. 2) are affected when button 34 on thumb lever 90 is pressed from the left (at the lower side in FIG. 2), as indicated by arrow 92. Dright is similarly the effective span across which the support positions on the right side are affected when button 34 on thumb lever 90 is pressed from the right, as indicated by arrow 92.

In general, the term "effective span" is used herein to refer to an extent or spread between the outer limits of a set of support positions. In the implementation of FIGS. 1 and 2, the left and right sets of support positions each have substantially constant effective spans in a forward-backward direction at every position in the elevation direction. In principle, however, a set of support positions could have an effective span that varies and that could be measured in more than one direction.

In the orientation shown in FIG. 2, Dleft and Dright are approximately perpendicular both to the elevation direction indicated by arrows 32 in FIG. 1 and also to the pressing direction indicated by arrow 92. But because Dright is smaller than Dleft and is positioned with its ends between the ends of Dleft, pressure on thumb lever 90 does not produce any lateral, rolling or rocking-type movement of elevation block 30 relative to frame 26. This is an example of one effective span, Dright, being "within a stable range" relative to another effective span, Dleft.

As used herein, the effective span of a first set of support positions is "within a stable range" relative to the effective span of a second set if the two effective spans are such that a force applied to both sets in approximately the direction from the first set to the second set (e.g. the direction of arrow 92) does not cause a rolling or rocking movement or the like; in other words, the first set holds its lateral position relative to the second set as the force is applied. In the relatively simple example of FIGS. 1 and 2, each set includes only two support positions, and the effective spans are approximately parallel, so that effective spans within a stable range can be achieved simply by keeping Dright shorter than and within Dleft as shown, but in other implementations a stable range could include positions in which one end of Dright is outside the limit of Dleft, and stable ranges could also be found for sets with different numbers of support positions, including a first set with only one support position and a second set with more than one and also first and second sets, one or both of which have more than two support positions. Furthermore, stable ranges could even be found where one or both sets of support positions have effective spans that vary or that are not parallel as in FIGS. 1 and 2.

The support positions are structured so that elevation block 30 can repeatedly slide in the elevation direction upward and downward along the length of frame 26. Parts, components, or surfaces "can repeatedly slide", as that expression is used herein, when they can slide many times without significant destructive effects on the sliding surfaces.

The mechanism that allows both coarse and fine adjustment of the position of the elevation structure involves additional parts of the elevation structure that interact with threaded rod 40. Thumb lever 90, mentioned above, controls these additional parts in response to a user's pressing or releasing button 34, in effect acting as a clutch that either disengages or engages elevation block 30 and threaded rod 40. For this purpose, thumb lever 90 is spring-biased by spring 94 into a position in which it holds nut 96 against rod 40. In an exemplary implementation, rod 40 is an Acme threaded ¼ inch stainless steel rod, and nut 96 is a counterpart stainless steel part with Acme threads that firmly engage rod 40. Acme threading permits better engagement of nut 96 with rod 40, and therefore more solid positioning.

Nut 96 fits into and slides on housing 100, which is in turn attached to elevation block 30. Thumb lever 90 pivots on a pin (not shown) mounted on elevation block 30 and is connected to nut 96 by another pin (not shown). As a result, when button 34 on thumb lever 90 is released, nut 96 engages rod 40 and the elevation structure can be moved in the elevation direction only by turning one of knobs 36 and 38 to make a fine adjustment. On the other hand, when button 34 on thumb lever 90 is depressed by pressing in the direction indicated by arrow 92, nut 96 moves in a direction indicated by arrow 102, disengaging from rod 40; when nut 96 is disengaged, upward or downward pressure on housing 30 relative to frame 26 causes the elevation structure to move in the elevation direction, providing coarse adjustment by moving quickly to a position at which fine adjustment can be performed with one of knobs 36 and 38 to obtain a desired elevation. Quick elevation adjustment by a coarse-fine technique is especially useful because elevation must typically be adjusted often to accommodate different target distances, while other adjustments are typically not needed as often.

Figure 3:
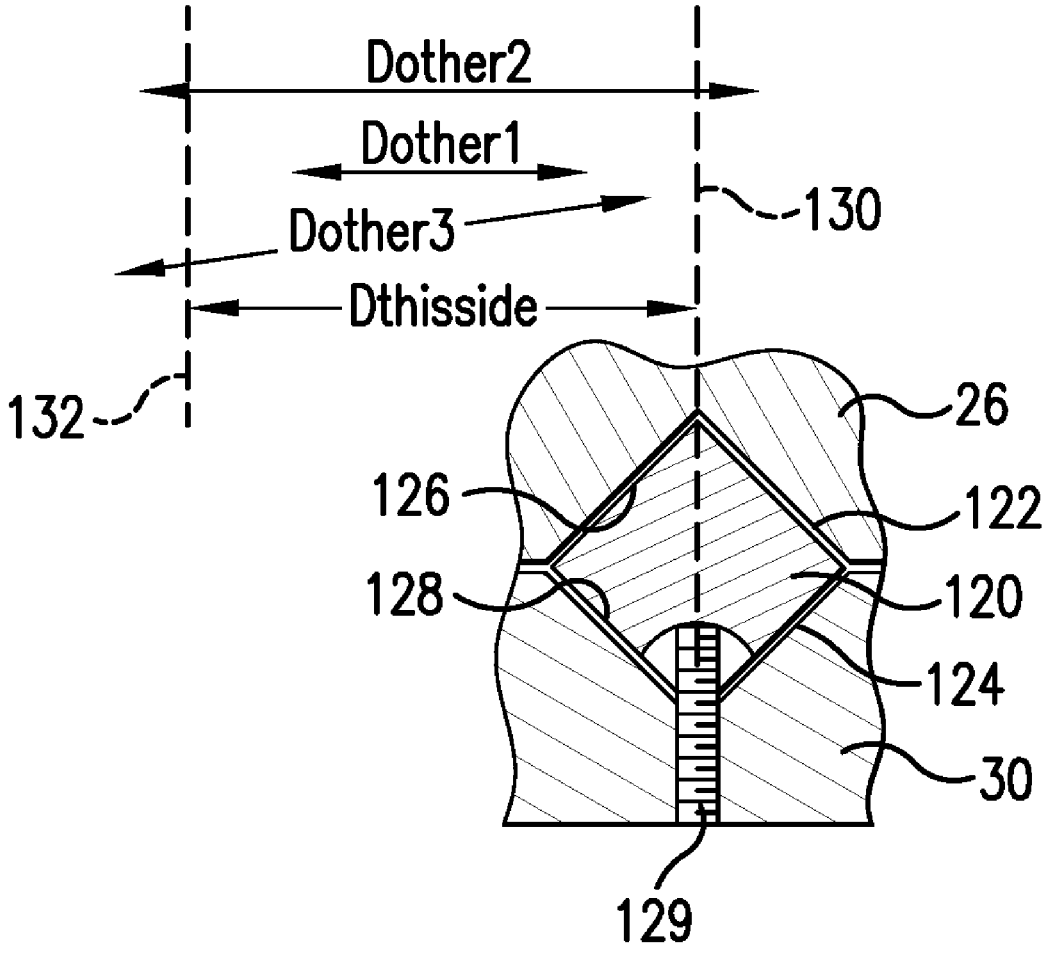
FIG. 3 is a cross-sectional view of a support position like those in FIG. 2.

FIG. 3 shows a support position as in FIG. 2 in greater detail. In general, the features shown in FIG. 3 would be present at each of the four support positions shown in FIG. 2, with some specific details being different as described below.

A part of frame 26 is on one side of the support position, and a part of elevation block 30 is on the other side with gib 120 between them. As used herein, a "gib" is a part that operates between two other parts, such as by holding the other parts in place, affording a bearing or sliding surface between them, or overcoming looseness between them Surface 122 of frame 26 is disposed toward surface 124 of elevation block 30, and gib 120 similarly has surfaces 126 and 128 disposed toward surfaces 122 and 124, respectively. In the implementation illustrated in FIGS. 1 and 2, gib 120 operates as part of the elevation structure that also includes elevation block 30, so that its surface 126 operates as a facing guide surface to surface 122 of frame 26, which operates as a guide surface. The guide surface and facing guide surface are substantially parallel, and they are capable of repeatedly sliding against each other in the elevation direction, due in part to features described in greater detail below. More generally, the term "guide surface" refers to a surface that participates in a sliding or similar operation, such as by being a sliding surface or by being a surface on which a gib with a sliding surface is mounted.

The cross section shown in FIG. 3 illustrates that one corner of gib 120 has a central recess that receives the end of dowel 129. Dowel 129 extends through elevation block 30 and into the central recess in gib 120, preventing gib 120 from moving upward or downward relative to elevation block 30.

Line 130 is a "center line", meaning a line that extends in the direction of pressure represented by arrow 92 (FIG. 2) and that intersects at approximately the centers of area of guide surface 122 and facing guide surface 126, and this center line is at the end of the effective span such as Dright and Dleft as shown in FIG. 2, as illustrated by effective span Dthisside to center line 132 of another support position. FIG. 3 also shows several possible effective spans on the other side, with Dother1 shorter, Dother2 longer, and Dother3 differently oriented than Dthisside. In each case, it can be determined when one of the effective spans is within a stable range relative to the other.

The guide surfaces and facing guide surfaces could have any suitable cross-sectional shape, including circular, hexagonal, etc., but the square cross-sectional shape of gib 120 is convenient for manufacturing purposes, and the combination of V-shaped surfaces with a square gib also provides enhanced stability: With two support positions as in FIG. 3 on each side of elevation block 30 as in FIG. 2, and with each V-shaped guide surface including two flat surfaces, there are four flat surfaces on each side of elevation block 30, and a total of eight surfaces; because they are all parallel to the elevation direction yet perpendicular to each other in each V-shape, these surfaces provide axial alignment in the elevation direction, preventing relative movement between block 30 and frame 24 in directions perpendicular to the elevation direction. The features shown in FIG. 3 make it possible to reduce relative movement until it is "negligible", meaning that it is so small that its effects are not noticeable by an archer during normal operation. The surfaces on the left side (at the top side in FIG. 2) remain fixed, while those on the right side (at the lower side in FIG. 2) are adjustable as described in greater detail below.

Figure 4:
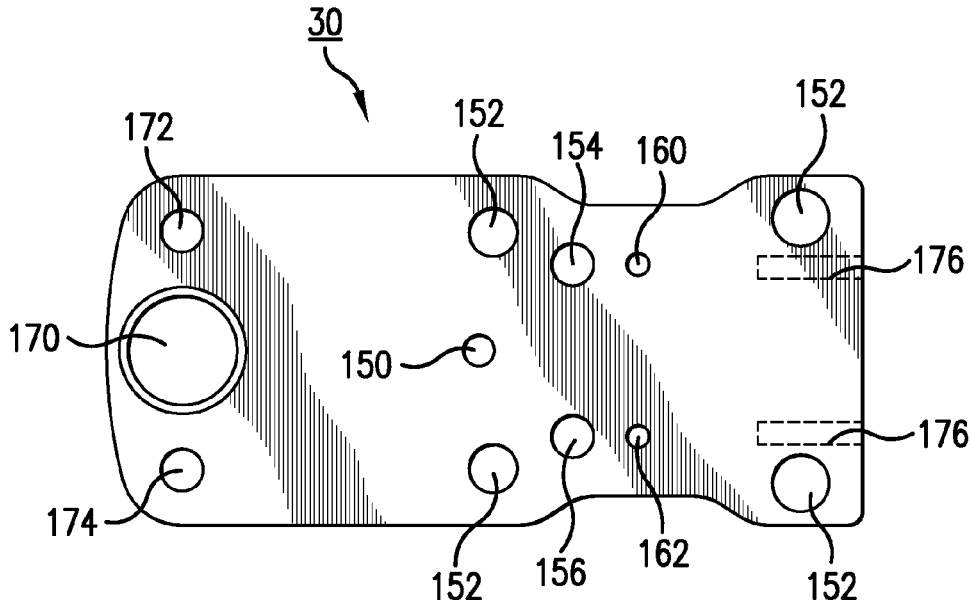
FIG. 4 is a side view of an elevation block as in FIGS. 1-3.

FIG. 4 shows one side of elevation block 30, as viewed from the right in FIG. 2, illustrating various holes through which screws, pins, rods, and so forth extend. Holes 150 each accommodate a fastener or other part like dowel 129 in FIG. 3, while holes 152 accommodate other parts that engage or relate to gib 120 or other such gibs. Holes 154 and 156 accommodate screws (not shown) that extend through housing 100, while holes 160 and 162 accommodate small pins that extend through elevation block 30 into housing 100 from one side only, assisting in stabilizing housing 100. Hole 170 accommodates screw 74, and holes 172 and 174 accommodate additional rods described below in relation to support of windage block 80 on elevation block 30. Screw holes 176 can each accommodate a screw, such as to hold pointer 42 in position.

Figure 5:
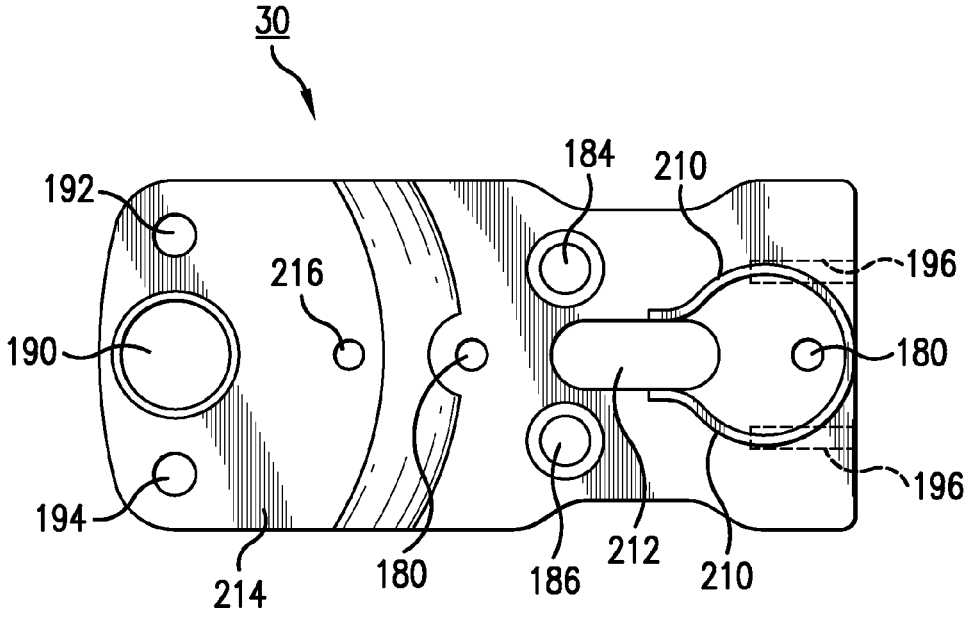
FIG. 5 is another side view of an elevation block as in FIGS. 1-4.

FIG. 5 shows the opposite side of elevation block 30, with several holes that relate to holes shown in FIG. 4. For example, holes 180 are counterparts of holes 150, and dowels similar to dowel 129 are inserted in them to hold gibs like gib 120 in position. Similarly, holes 184 and 186 are counterparts of holes 154 and 156, respectively, but with shallow recesses around the holes as shown to accommodate the heads of screws. Also, hole 190 is a counterpart of hole 170; holes 192 and 194 are counterparts of holes 172 and 174, respectively; and holes 196 are counterparts of holes 176. Although counterparts of holes 152 are not shown, partial holes or pockets could be drilled outward into elevation block 30 opposite holes 152, ending a short distance such as 0.03 inch from the outer surface shown in FIG. 5, and such pockets could, for example, accommodate springs as in FIG. 13, as described below; if such holes are drilled through the outer surface, they could be threaded to accommodate screws, as in alternative approaches described below in relation to FIGS. 11 and 13.

Figure 7:
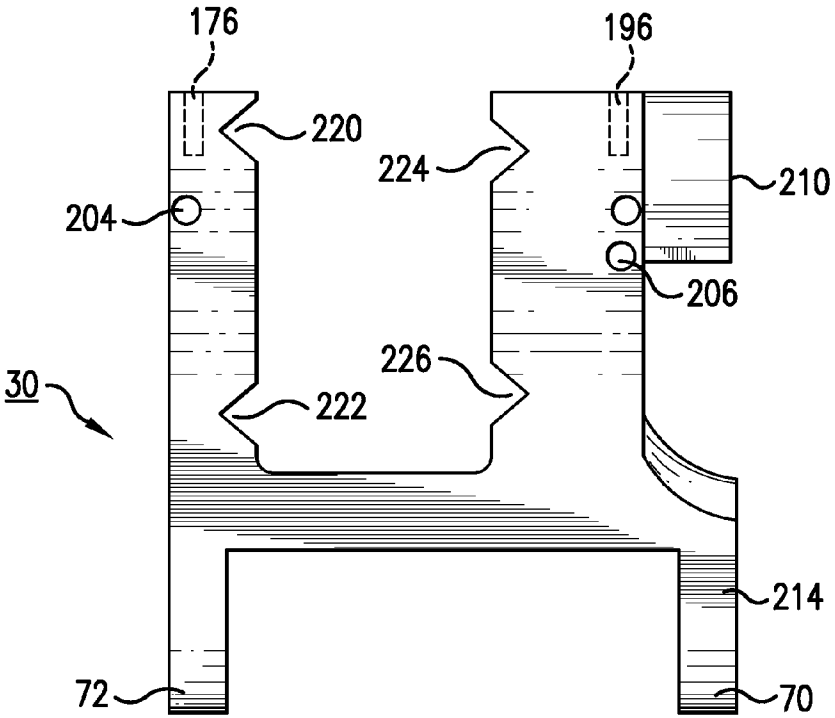
FIG. 7 is a bottom view of an elevation block as in FIGS. 1-6.
Figure 6:
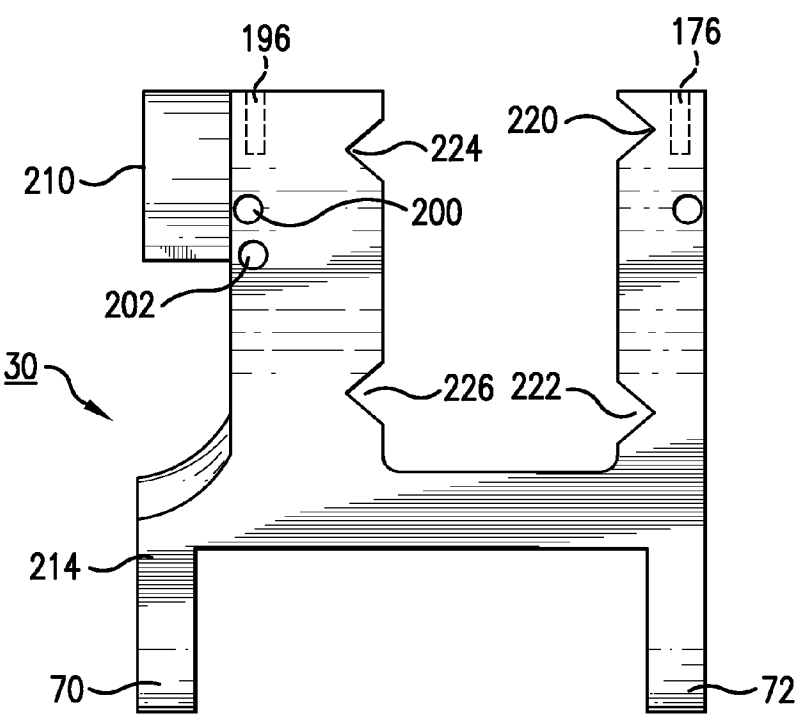
FIG. 6 is a top view of an elevation block as in FIGS. 1-5.

FIGS. 6 and 7, taken together with FIGS. 4 and 5, illustrate additional features of elevation block 30 that relate, for example, to thumb lever 90. Hole 200 in FIG. 6 holds pointer 42, and hole 202 accommodates a pin (not shown) that extends through thumb lever 90, providing a pivot point. Hole 204 in FIG. 7 similarly accommodates a pointer like pointer 42 but on the opposite side of frame 26, while hole 206 is the opposite end of hole 202, and accommodates the same pin or screw.

FIGS. 5-7 also illustrate collar 210, which holds spring 94 (FIG. 2) that biases thumb lever 90 so that it holds nut 96 against threaded rod 40. Collar 210 is open when it meets slot 212, with its open sides extending a short distance along slot 212, through which thumb lever 90 extends: Thumb lever 90 can pivot about the pin through hole 202, moving from side to side in slot 212 between the open sides of collar 210.

As shown in FIG. 2, screw 74 is substantially longer than the width of frame 26, and is even slightly longer than the width of elevation block 30 in the area in which it extends around frame 26. Therefore, elevation block 30 includes flared portion 214 on the same side as collar 210, so that arms 70 and 72 have the appropriate separation to accommodate screw 74. Hole 216 in flared portion 214 can hold a spring-biased ball bearing, such as a stainless steel ball bearing with 0.125 inch diameter, or other small solid part (not shown) that engages grooves on the facing side of knob 52, so that knob 52 moves between discrete positions as it is turned; this movement can be described as "clicking" and each "click" between positions can be accompanied by an audible sound, but materials could optionally be used to reduce or avoid audible clicking sounds that could alert animals to an archer's presence. Each "click" between positions can produce a small leftward or rightward movement of the windage structure that includes windage block 80, such as approximately 0.0015 inch.

FIGS. 6 and 7 also show gib-mounting surfaces 220, 222, 224, and 226, each of which is an example of surface 124, described above in relation to FIG. 3. FIGS. 8-13 illustrate examples of gibs that can be mounted on these surfaces, with the example in FIGS. 8-9 being appropriate for mounting on surfaces 220 and 222 and with the gibs shown in FIGS. 10-13 being appropriate for mounting on surfaces 224 and 226 in two alternative implementations. These are examples of "mounting surfaces", meaning surfaces that contact or otherwise engage other parts, components, or surfaces during a mounting operation.

In the implementations described below, gibs on surfaces 220 and 222 are referred to as "fixed gibs" because they are relatively solid and inflexible, while the gibs mounted on surfaces 224 and 226 are referred to as "adjustable gibs" because their position can change to accommodate wear of the guide surfaces on frame 26 and the facing guide surfaces on the gibs. Frame 26 and elevation block 30 could be machined from a suitable metal such as stainless steel or aluminum and then anodized while the gibs could be machined from a softer material, so that substantially all wear would occur on the gibs.

Figure 8:
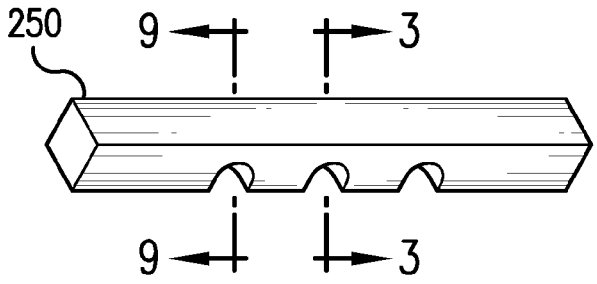
FIG. 8 is a side view of a fixed gib that could be used in a support position as in FIG. 2.
Figure 9:
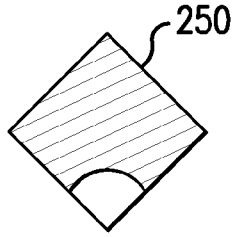
FIG. 9 is a cross-sectional view of a fixed gib, taken along the line 9-9 in FIG. 8.
Figure 10:
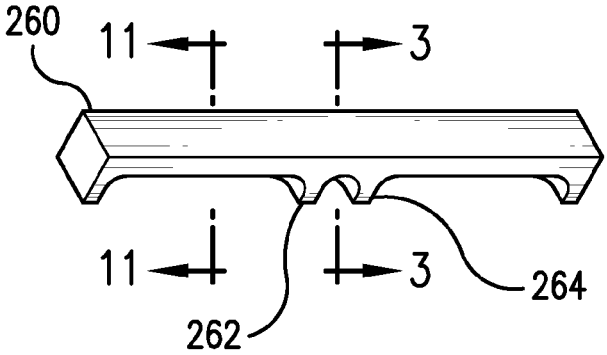
FIG. 10 is a side view of an adjustable gib that could be used in a support position as in FIG. 2.

FIG. 8 shows a side view of fixed gib 250, which has been successfully implemented by machining a square rod of Delrin® AF Blend, but could be implemented with bronze, brass, or other thermoplastic materials that have low friction, good temperature resistance, and long wear. As shown, the central cross section of fixed gib 250 is the same as shown in FIG. 3, with a central recess, while a cross section through either of the smaller indentations is as shown in FIG. 9. The smaller indentations can accommodate screws that extend past gib 250, such as through holes 176 (FIG. 4).

Figure 11:
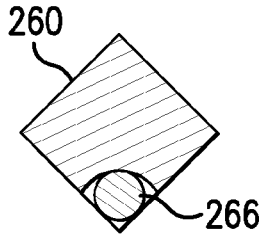
FIG. 11 is a cross-sectional view of an adjustable gib, taken along the line 11-11 in FIG. 10.

Adjustable gib 260 in FIG. 10 again has a central cross section like that in FIG. 3, and at the sides of the central recess, walls 262 and 264. Between walls 262 and 264 and the ends of gib 260 are two grooves, each with substantially the same cross section as in FIG. 3, but, in use, accommodating dowel 266, as shown in FIG. 11, or a small spring or other such object; in one implementation, each groove contains a square dowel pin that is 0.25 inch long and 0.06125 inch on a side. In an alternative approach, screws in holes opposite holes 152, as described above in relation to FIGS. 4 and 5, could be tightened to increase pressure between gib 260 and its guide surface on frame 26; loosening the screws would, conversely, reduce the pressure. In this way, the friction that must be overcome to make coarse and fine adjustments in the elevation direction can be adjusted, while at the same time compensating for any wear that has occurred on the guide surfaces of frame 26 or on the facing guide surfaces of the fixed and adjustable gibs. As with fixed gib 250 in FIGS. 8 and 9, adjustable gib 260 can be made of Delrin® AF Blend, machined as shown.

Figure 12:
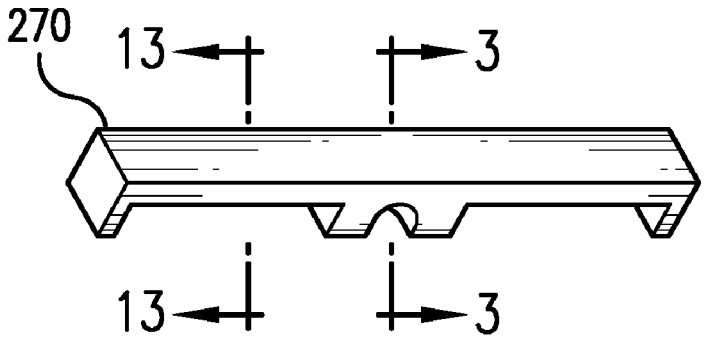
FIG. 12 is a side view of another adjustable gib that could be used in a support position as in FIG. 2.
Figure 13:
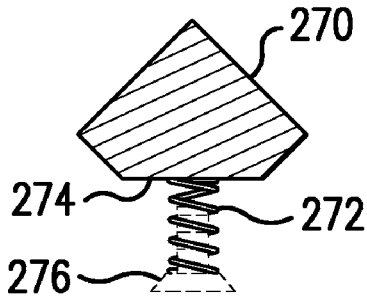
FIG. 13 is a cross-sectional view of an adjustable gib, taken along the line 13-13 in FIG. 12.

Adjustable gib 270 in FIG. 12 also has the same central cross section as in FIG. 3, but has a flat indented region near each end, as shown by the cross section in FIG. 13. In this case, spring 272 is held in a partial hole or pocket opposite hole 152 in elevation block 30, as described above in relation to FIGS. 4 and 5, and exerts pressure against flat surface 274. Spring 272 can therefore provide approximately constant pressure between guide surfaces on frame 26 and facing guide surfaces on the gibs and can also compensate automatically for any wear on those surfaces. The strength of spring 272 can be selected to obtain a desired level of friction between the surfaces. In an alternative approach shown in dashed outline, spring 272 could further be adjusted by turning screw 276, which can extend through a hole opposite hole 152 in elevation block 30.

The adjustable gibs shown and described above in relation to FIGS. 10-13 are expected to provide years of use based on initial prototype results. In addition, the implementation of FIGS. 12 and 13 is expected to provide approximately constant pressure consistently over a similar period of time, automatically compensating for wear without requiring adjustment of screws as in the implementation of FIGS. 10 and 11.

Figure 14:
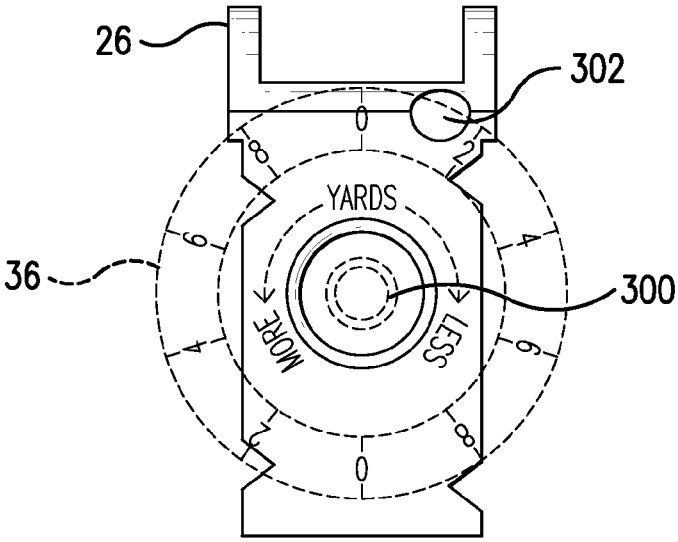
FIG. 14 is a top view of part of an archery sight system as in FIGS. 1-2.

FIG. 14 shows a top view of part of system 10, illustrating features of knob 36 (in dashed lines) and frame 26. As can be seen, the upper surface of knob 36 has markings to assist an archer in changing the position of elevation block 30 during fine adjustment; knob 38 could optionally have similar markings. By turning knob 36 (or knob 38) in one direction, illustratively counterclockwise, the distance can be increased, while turning in the other direction, illustratively clockwise, decreases the distance. Hole 300 in frame 26 accommodates an unthreaded region at the end of rod 40, and hole 302 holds a spring-biased part similarly to hole 216 in FIG. 5 so that elevation is adjusted in discrete clicks of approximately 0.0015 inch, similarly to the adjustment of windage block 80 described above.

Figure 15:
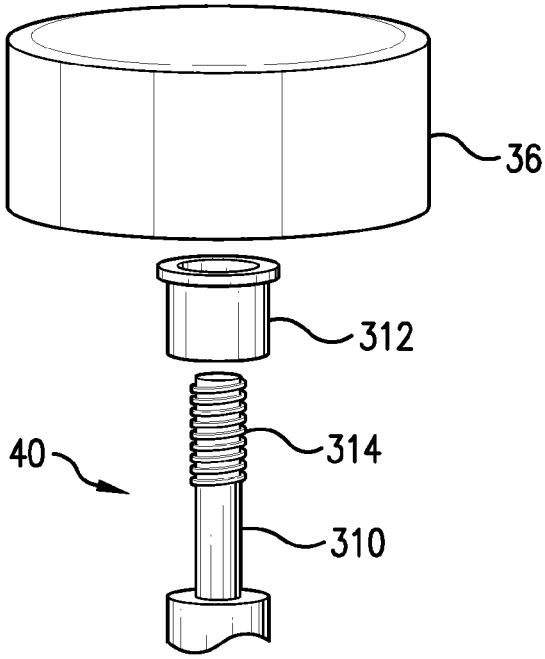
FIG. 15 is an exploded view including some parts visible in FIG. 14.

FIG. 15 shows an exploded view of parts that can be similarly assembled at each end of rod 40. As mentioned above, unthreaded portion 310 of rod 40 is positioned in hole 300 in frame 26, and bushing 312 fits around unthreaded portion 310 and inside hole 300 (FIG. 14) to provide a snug, low friction bearing; bushing 312 can, for example, be similarly made of Delrin® AF Blend. Then, knob 36 has fine inner threads that can be turned onto finely threaded portion 314 of rod 40. A decal (not shown) can be attached to the upper surface of knob 36, providing markings as described in relation to FIG. 14.

Figure 16:
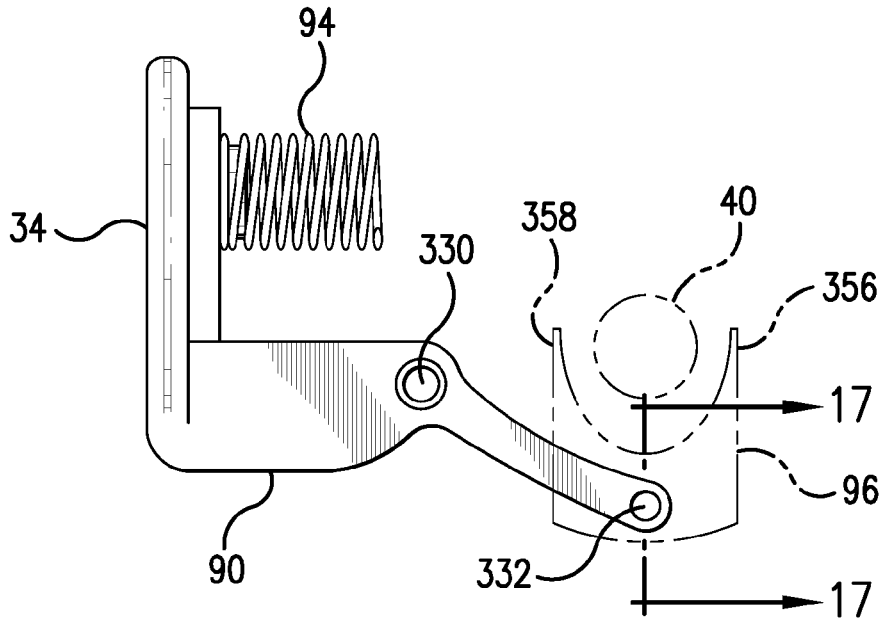
FIG. 16 is a top view of a spring-biased thumb lever and connected parts that can be used in the system of FIGS. 1-2.

FIG. 16 shows the relationship between thumb lever 90, spring 94, and nut 96. Hole 330 in thumb lever 90 is a pivot point, fixed to hole 206 (FIG. 7) in elevation block 30. As button 34 is pressed, thumb lever 90 pivots in the clockwise direction in FIG. 16, compressing spring 94 and pulling nut 96 away from rod 40. Thumb lever 90 is connected to rod 96 by a pin through hole 332. Therefore, when button 34 is released, spring 94 expands, pushing lever 90 in the counterclockwise direction around its pivot point and pushing nut 96 against rod 40 again.

Figure 17:
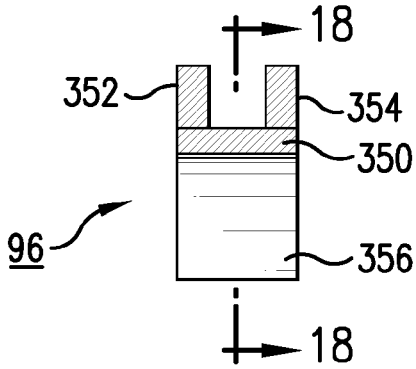
FIG. 17 is a cross-sectional view of a nut as in FIG. 16, taken along the line 17-17 in FIG. 16.

FIG. 17 shows a cross section of nut 96 at approximately its center as shown in FIG. 16. Central portion 350 can be substantially solid material in which threads are formed on a curved lower surface to engage threads on rod 40. Arms 352 and 354 extend upward from body 350 and have holes corresponding with hole 332 in thumb lever 90. Legs 356 and 358 extend beyond the threaded region of body 350 and fit within guideways in housing 100 so that nut 96 moves back and forth along the guideways.

Figure 18:
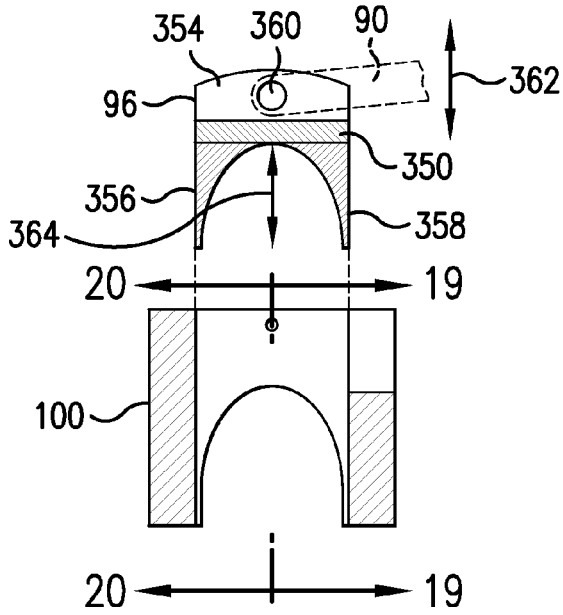
FIG. 18 is another cross-sectional view of a nut as in FIGS. 16-17, taken along the line 18-18 in FIG. 17.

The cross section in FIG. 18 shows the relationship between nut 96 and housing 100 in greater detail. At the upper part of nut 96, hole 360 in arm 354 receives a pin that also extends through thumb lever 90, so that thumb lever 90 and nut 96 are pivotably connected. As a result, when thumb lever 90 moves back and forth in the directions indicated by bidirectional arrows 362, nut 96 also moves back and forth in the directions indicated by bidirectional arrows 364, moving into and out of housing 100. Slot 212 (FIG. 5) limits the movement of thumb lever 90, which can in turn limit the movement of nut 96 toward rod 40, shown in a dashed dash line outline. When legs 356 and 358 slide along the guideway, they can reach a position in which the threads on the underside of body 350 are fully engaged with the threads of rod 40, allowing fine adjustment.

Figure 19:
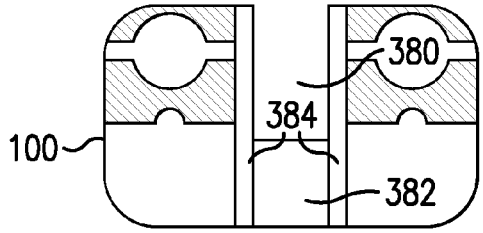
FIG. 19 is a cross-sectional view of a nut housing, taken along the line 19-19 in FIG. 18.
Figure 20:
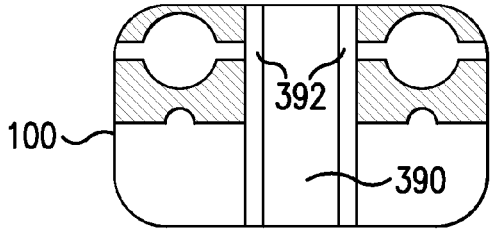
FIG. 20 is another cross-sectional view of a nut housing, taken along the line 20-20 in FIG. 18.

FIG. 19 shows the guideway for leg 358, and FIG. 20 shows the guideway for leg 356. In the cross section in FIG. 19, slot 380 is shaped so that thumb lever 90 can move within it as it moves nut 96 back and forth along guideway 382, each side of which has a slight groove 384. Similarly, guideway 390 in FIG. 20 has slight grooves 392 at its sides, but does not include a slot similar to slot 380 because it is positioned opposite the side at which thumb lever 90 extends into housing 100.

Figure 21:
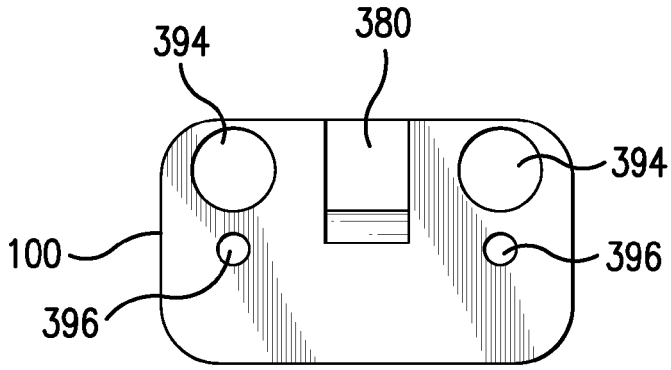
FIG. 21 is a side view of a nut housing as in FIGS. 18-20.

FIG. 21 shows the exterior of housing 100 when viewed from the direction opposite the view in FIG. 19, with slot 380 opening into the interior. Holes 394 accommodate screws extending through holes 154, 156, 184, and 186 in FIGS. 4 and 5 to hold housing 100 in position within elevation block 30. Holes 396 are opposite similarly positioned holes that accommodate pins extending through holes 160 and 162 in FIG. 4.

The shapes and other features of nut 96 and housing 100 are illustrative only, and similar parts with other shapes or that operate differently could be used. It has been found in the above implementation, however, that a very tight tolerance on the lateral sides between nut 96 and housing 100, such as 0.0005 inch, helps ensure solid thread-to-thread engagement between nut 96 and rod 40.

The features of elevation component 22 described above allow the elevation structure to be quickly positioned for a desired shooting distance through a combination of coarse and fine adjustment. In addition, elevation block 30 provides arms 70 and 72 (FIG. 2) on which windage block 80 can be supported and adjusted to compensate for effects such as wind. In addition, windage block 80 includes features that allow other parts of scope mounting component 24 to be quickly and conveniently mounted on it or dismounted from it, such as to exchange one bowsight for another or to replace one type of scope mounting attachment 24 with another.

Figure 22:
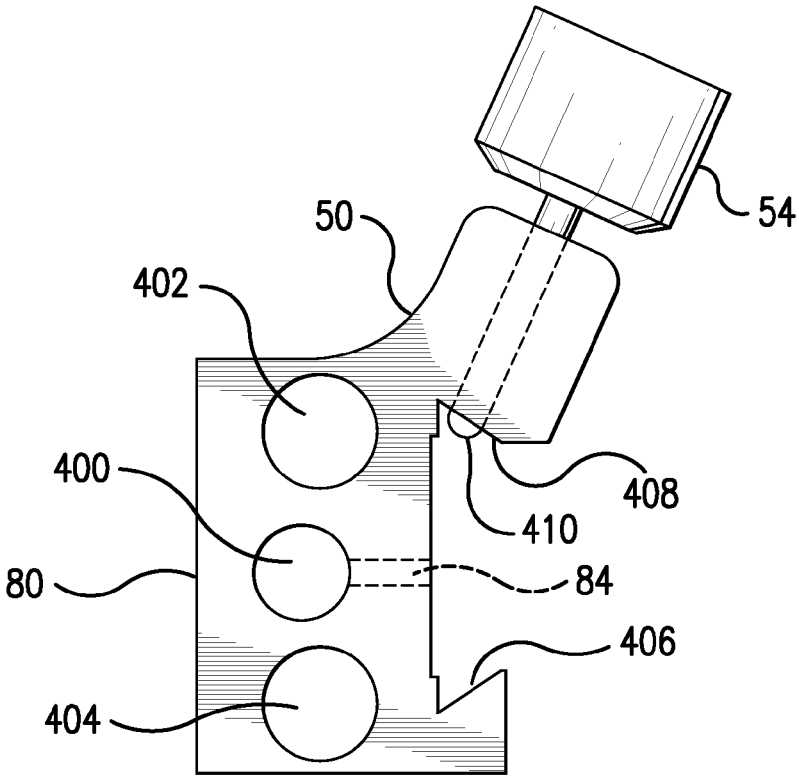
FIG. 22 is a side view of a windage block that can be used in the system of FIGS. 1-2.

FIG. 22 shows windage block 80 from the left side in FIG. 2. In addition to part 50 through which lock screw 54 extends, windage block 80 has a main body with threaded holes 400, 402, and 404 extending through it. Threaded hole 84 also extends into hole 400 for lubrication purposes, as described above. The female dovetail recesses 406 and 408, illustratively with internal angles of approximately 60 degrees, allow scope mounting attachment 24 to be mounted and dismounted by sliding a counterpart male dovetail component in or out at either side, with lock screw 54 having nylon end 410 that secures scope mounting component 24 in place when lock screw 54 is tightened; lock screw 54 can also be loosened to allow dismounting.

Figure 23:
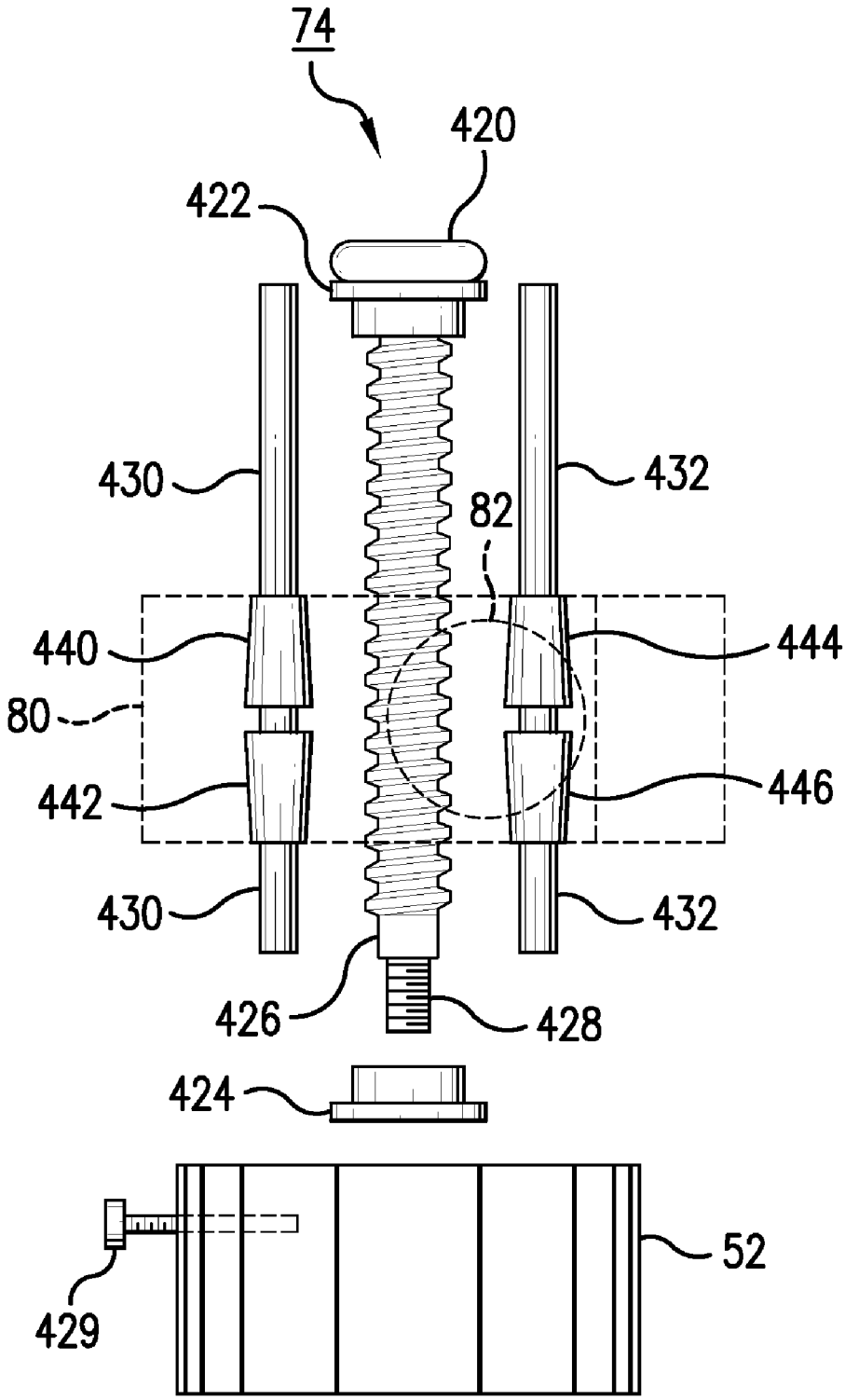
FIG. 23 is an exploded view that includes parts that can extend through a windage block as in FIG. 22.

FIG. 23 shows components by which windage block 80 (shown in dashed line) is mounted on elevation block 30, with its position adjustable by turning knob 52. Unlike elevation block 30, windage block 80 does not have a coarse adjustment.

Screw 74 extends from screw head 420 through bushing 422, through hole 400 (FIG. 22) in windage block 80, through bushing 424, and into knob 52. For this purpose, screw 74 can have a main threaded portion 426 and, at either end of main threaded portion 426, an unthreaded portion within the respective one of bushings 422 and 424. Beyond bushing 424, screw 74 can also include a finely threaded portion 428 that turns into an opening in knob 52 and can be held in place by set screw 429. Screw 74 can, for example, be implemented as a 10-32 screw with appropriate threading and length. Bushings 422 and 424 can be implemented, for example, as Delrin® AF bushings or other suitable bushings to provide low friction bearing surfaces between screw 74 and the inner surfaces of holes 170 and 190 (FIGS. 4 and 5).

At either side of screw 74 are guide pins 430 and 432, extending through holes 402 and 404, respectively. Within each of holes 402 and 404, around the respective one of pins 430 and 432, is a respective pair of tapered bushings that provide bearing surfaces allowing windage block 80 to slide smoothly along the length of pins 430 and 432 without developing looseness as a result of repeated sliding. Specifically, tapered bushings 440 and 442 are on pin 430 within hole 402 (FIG. 22), and tapered bushings 444 and 446 are on pin 432 within hole 404 (FIG. 22). In each case, each tapered bushing can, for example, be made of Delrin® AF 4-plus Blend and can have slightly larger inside and outside diameters at the end facing toward the other bushing with which it is paired than at the opposite end. For example, the diameters of bushings 440 and 442 at their ends that face each other can be slightly larger than the diameters at their ends away from each other, and similarly the diameters of bushings 444 and 446 at their ends that face each other can be slightly larger than the diameters at their ends away from each other. Guide pins 430 and 432 can, for example, be made of ⅛ inch dowel machined to an appropriate length and fitting into holes 172, 174, 192, and 194 in arms 70 and 72 of elevation block 30.

Holes 400, 402, and 404 can be tapped with minor diametral thread depth, and tapered bushings 440, 442, 444, and 446 can be pressed into holes 402 and 404. Each bushing's larger diameter end is positioned toward the center, as described above, by a press-fit operation. As one of guide pins 430 and 432 is inserted through the respective tapered bushings, the pin's circumferential surface engages each bushing's smaller diameter end, which is sufficiently elastic to stretch, expanding to fit tightly around the pin's circumferential surface. This allows each bushing's inner diameter to float along the outer diameter of the guide pin inside it, allowing dimensional variation in the bore while maintaining consistent pressure on the guide pins at the outer edges of tapered bushings 440, 442, 444, and 446 along the outer surfaces of windage block 80. Slop and wear is reduced because the bushing material, such as Delrin® AF, floats along the external surfaces of pins 430 and 432, and there is minimal "sandwiching" of the press-fit between the bushings and the pin inside them. In addition, the biasing pressure from wave spring washer 86 (FIG. 2) in recess 82 can provide substantially constant directional force between guide pins 430 and 432 and the inner surfaces of tapered bushings 440, 442, 444, and 446, compensating for any wear in the tapered bushings.

Figure 24:
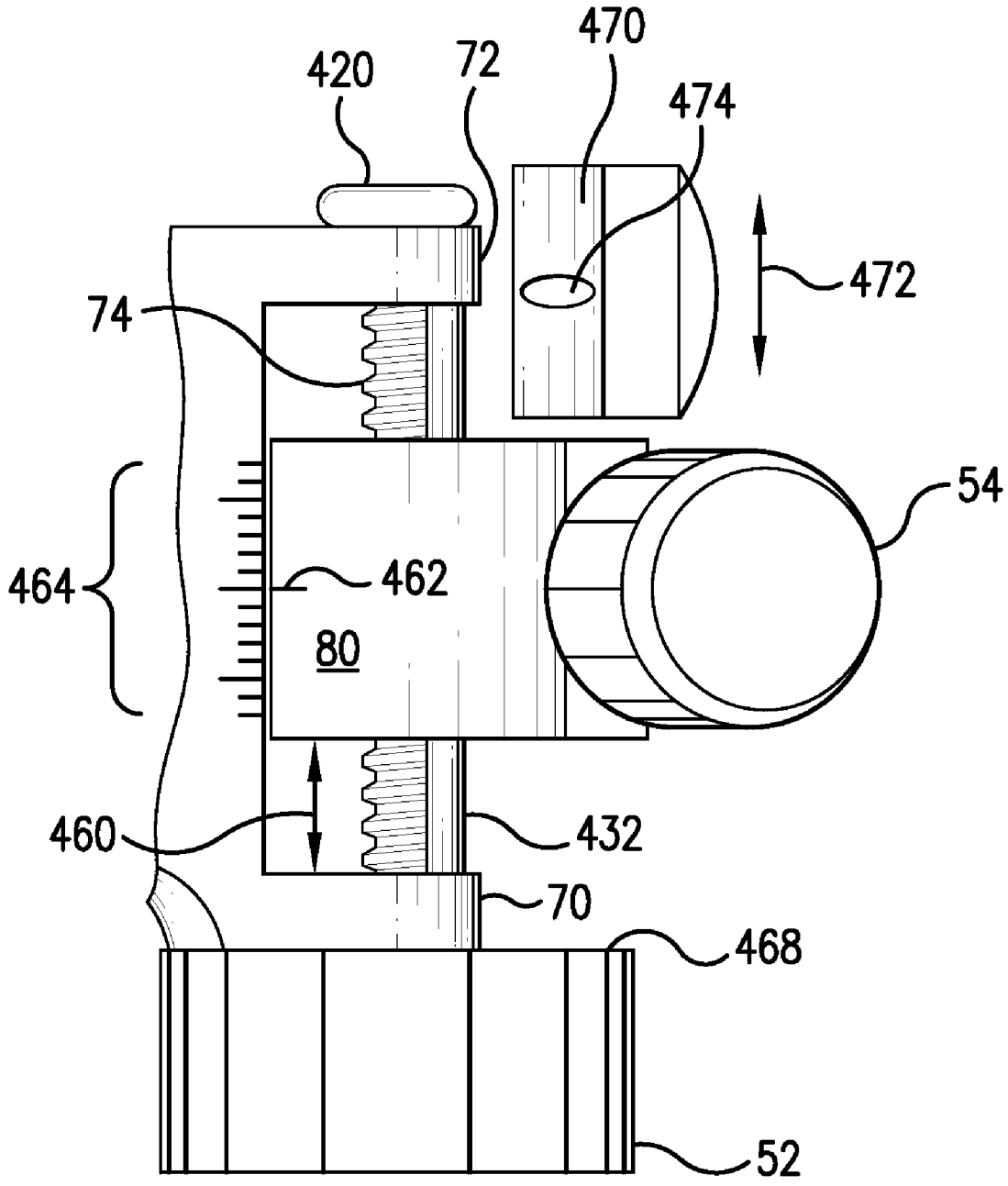
FIG. 24 is a top view of an archery sight system as in FIGS. 1-2, including some parts as in FIG. 23.

FIG. 24 shows how windage block 80 can move back and forth relative to elevation block 30 in response to turning of knob 52, as indicated by bidirectional arrows 460, indicating windage directions. Marking 462 on windage block 80 and markings 464 on elevation block 30 and can be visually aligned in a desired position. In addition, spring-biased ball bearing 78 (FIG. 2) in hole 216 (FIG. 5) engages grooves 468 on knob 52, providing further feedback to a user with clicking, as described above, because each click between positions can indicate a movement of, for example, 0.00156 inch.

FIG. 24 also shows male dovetail part 470 which can slide into and out of female dovetail recesses 406 and 408 (FIG. 22) as indicated by bidirectional arrows 472, to mount or dismount scope mounting component 24. Part 470 has indentation 474 to receive the nylon tip of lock screw 54, for secure mounting.

Figure 25:
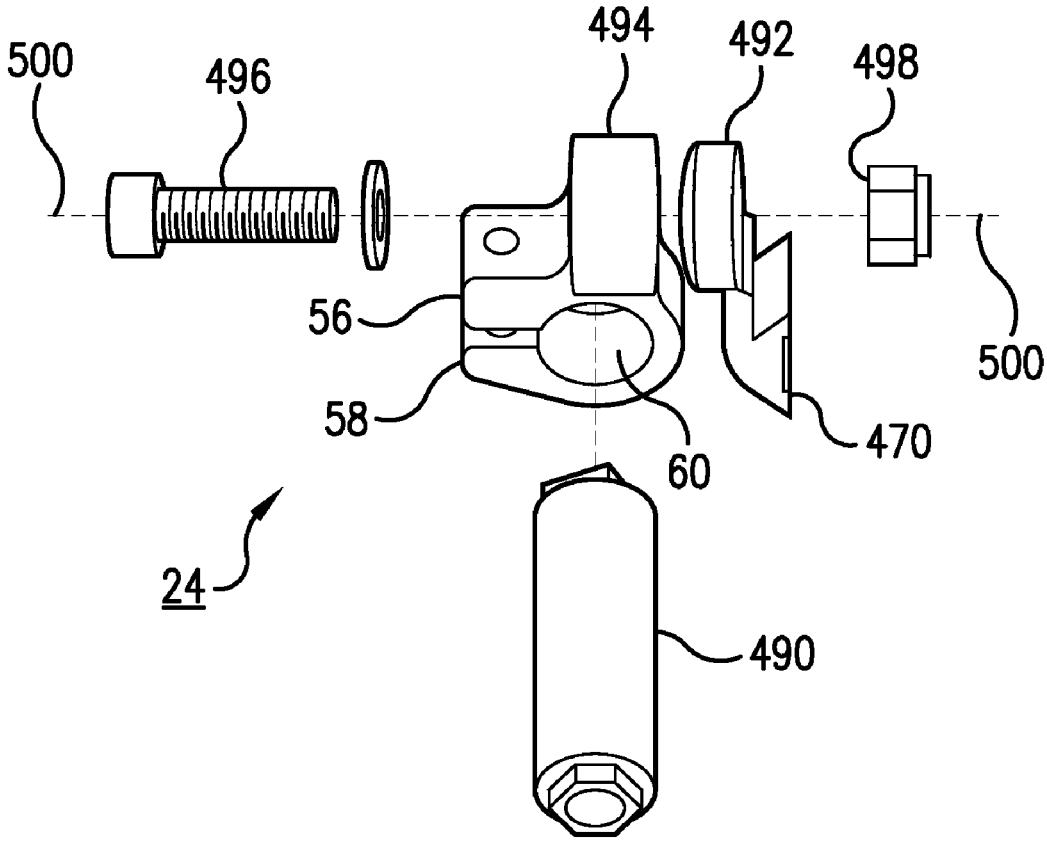
FIG. 25 is an exploded view of a scope mounting attachment that can be used in the archery sight system of FIGS. 1-2.

FIG. 25 is an exploded view showing parts of one implementation of scope mounting component 24, together with scope housing 490. In this implementation, male dovetail part 470 (FIG. 24) is part of axis block 492, while clamp arms 56 and 58 are parts of C clamp 494.

Axis block 492 has a convex mounting surface disposed toward C clamp 494, which has a mating concave mounting surface, so that when screw 496 and convex Nylock nut 498 are loosened, C clamp 494 can be rotated about axis 500 to adjust the position of a scope. Also, if screw 496 is smaller than the opening through C clamp 494, C clamp 494 can also be turned a few degrees relative to axis block 492, allowing further adjustment of the position of a scope. Then, when nut 498 is again tightened onto screw 496, the position of a scope held by scope housing 490 is stabilized.

If scope mounting component 24 as in FIG. 25 is dismounted from windage block 80 in the manner shown in FIG. 24 after nut 498 is tightened into screw 496, component 24 can be later remounted and the scope will have the same position as before it was dismounted. In other words, an archer can have several scope mounting components 24, each with a respective scope, accurately adjusted; the archer can choose any of the scopes, mount it on windage block 80, and use it without further adjustments of the position of C clamp 494 or of scope housing 490.

Figure 26:
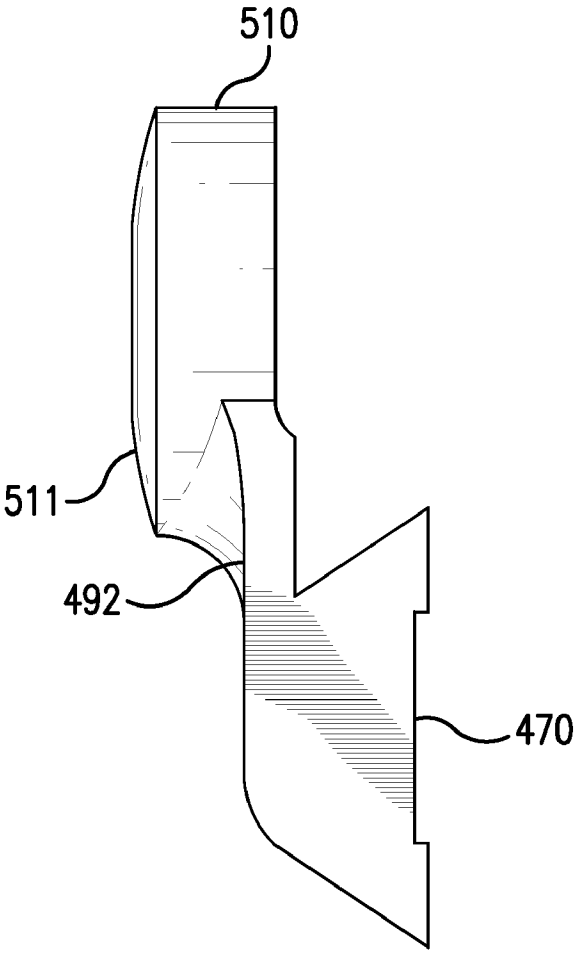
FIG. 26 is a side view of an axis block as in FIG. 25.

FIG. 26 shows a side view of axis block 492, illustrating male dovetail part 470 at one end and collar portion 510 at the other. As shown, collar portion 510 has convex surface 511. In this implementation, axis block 492 can be made of a hard plastic or metal material machined to the desired shape.

Figure 27:
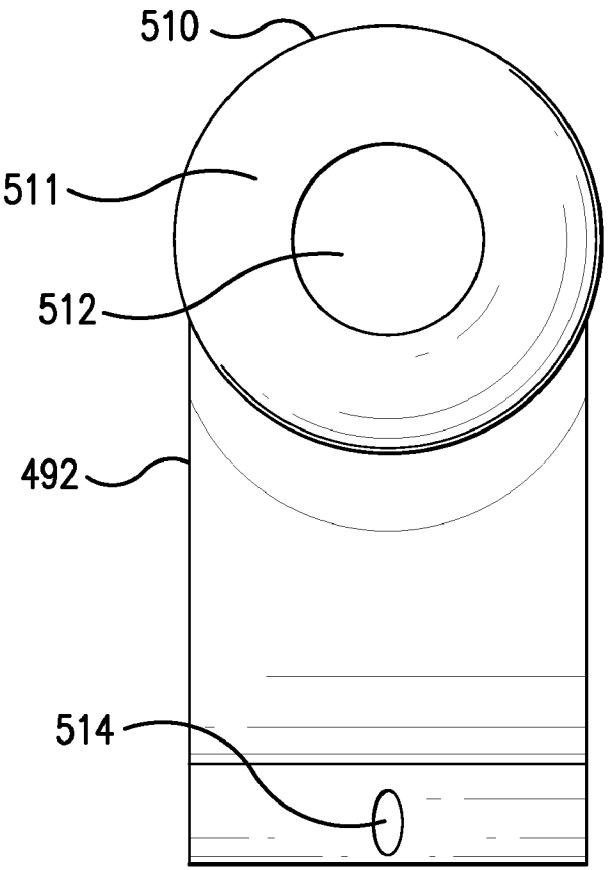
FIG. 27 is another side view of an axis block as in FIGS. 25-26.

FIG. 27 shows another side view of axis block 492, showing hole 512 in collar portion 510. FIG. 27 also shows recess 514 on one side of male dovetail part 470, positioned to receive the nylon end of lock screw 54 to hold axis block 492 firmly in position on windage block 80.

Figure 28:
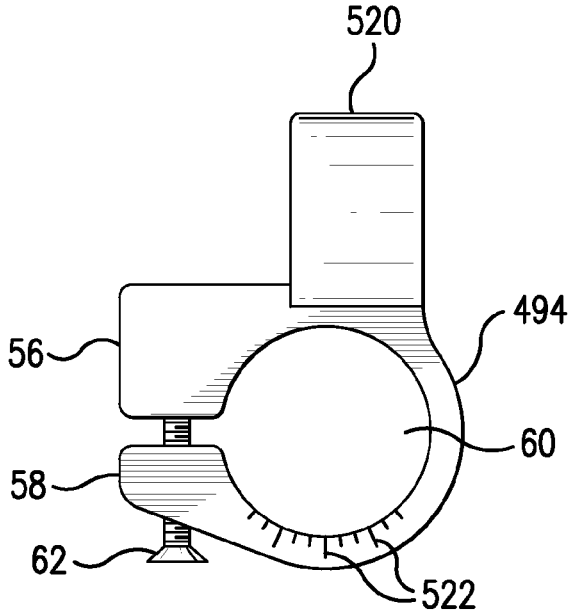
FIG. 28 is a side view of a C clamp as in FIG. 25.

FIG. 28 shows C clamp 494 with clamp arms 56 and 58, opening 60, and screw 62. In addition, sleeve portion 520 extends outward from the base of arm 56. FIG. 28 also shows markings 522, which can be used to accurately position scope housing 490 based on markings on its outer surface.

Figure 29:
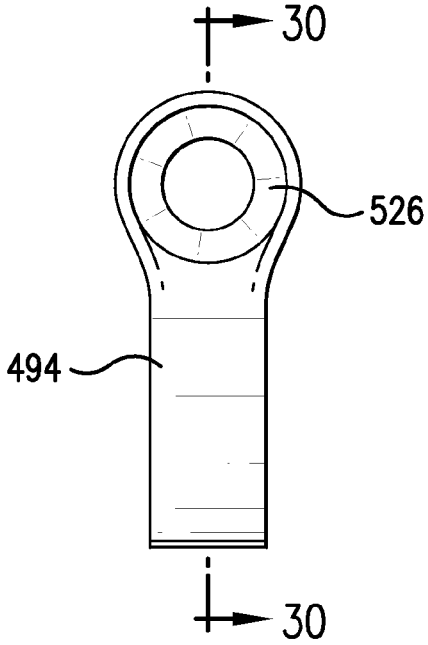
FIG. 29 is another side view of a C clamp as in FIGS. 25 and 28.

FIG. 29 shows C clamp 494 from the right in FIG. 28. Sleeve portion 520 surrounds hole 524 and has concave surface 526 which mates with convex surface 511 of collar portion 510, allowing adjustments as described above.

Figure 30:
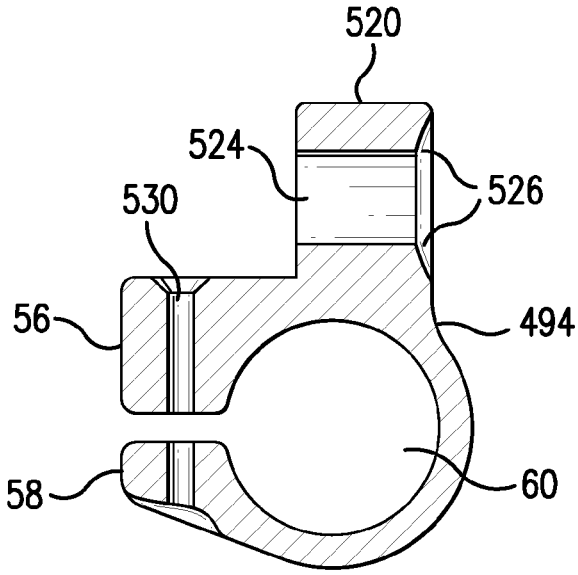
FIG. 30 is a cross-sectional view of a C clamp, taken along the line 30-30 in FIG. 29.

FIG. 30 shows a cross section of C clamp 494 along the line 30-30 in FIG. 29. In addition to collar portion 520 with hole 524 and concave surface 526, FIG. 30 also shows hole 530 through arms 56 and 58 threaded as appropriate for screw 62. C clamp 494 can be made, for example, from stainless steel, aluminum, or other appropriate metal, and its surface can be anodized.

Figure 31:
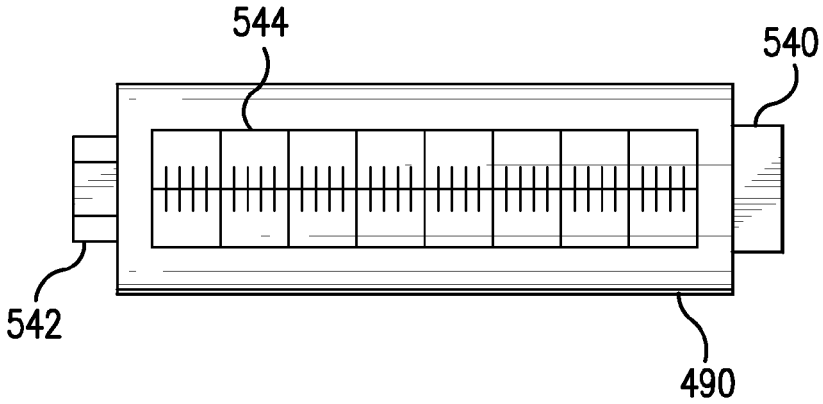
FIG. 31 is a side view of a scope housing as in FIG. 25.

FIG. 31 shows a side view of scope housing 490, which can similarly be made from stainless steel, aluminum, or other appropriate metal and can also be anodized. To provide various adjustment options, scope housing 490 has a square-shaped turnable part 540 at one end and hexagonal turnable part 542 at the other. Along the side of scope housing 490 is grid 544 of markings, which an archer can use in adjusting the position of scope housing 490 within C clamp 494. In use, a scope's mounting bolt or rod can be inserted through a central opening in housing 490, and can then be held tightly in housing 490, such as with a nut tightened onto the bolt or rod at the end of housing 490 opposite the scope.

Figure 32:
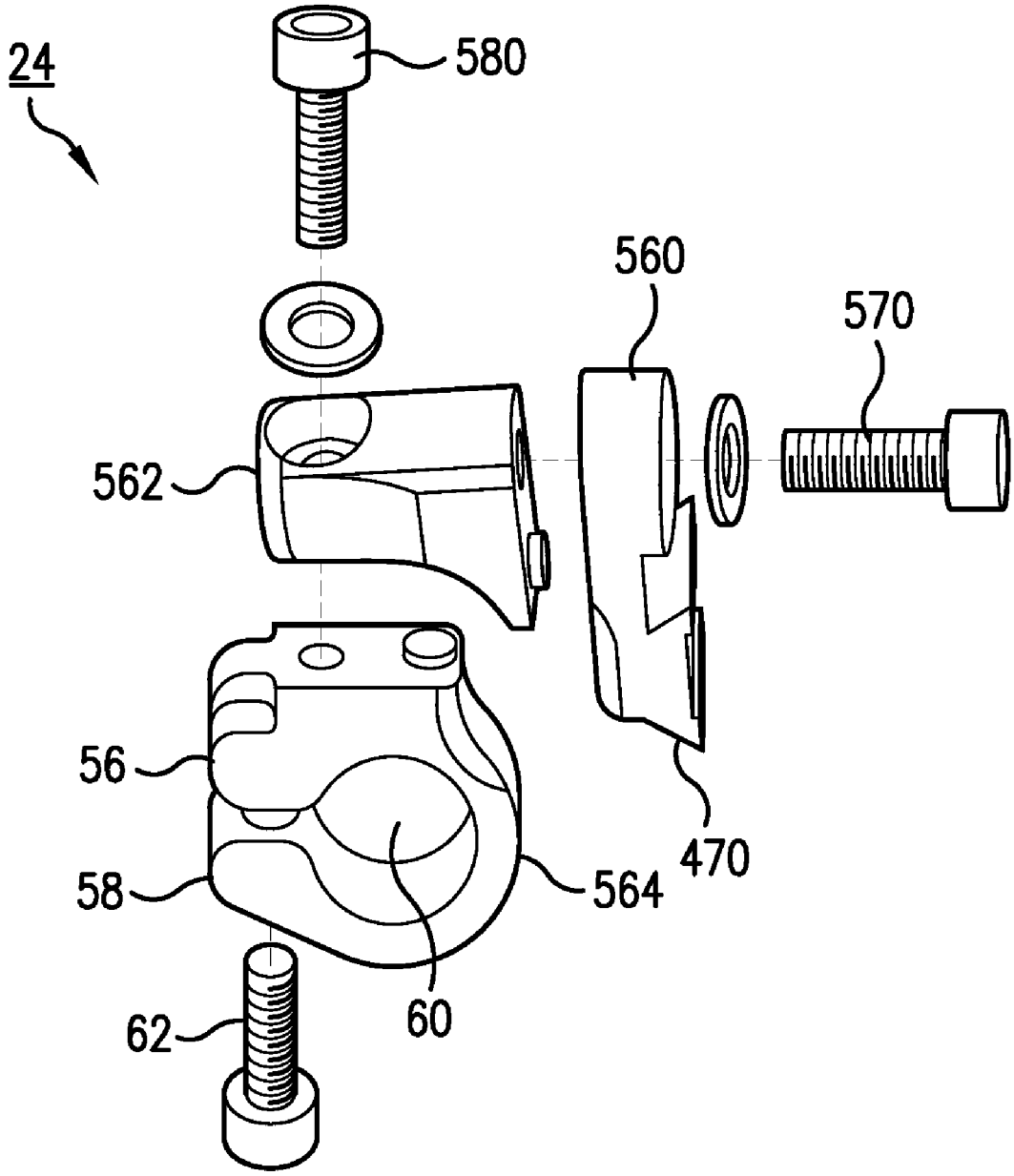
FIG. 32 is an exploded view of another scope mounting attachment that can be used in the archery sight system of FIGS. 1-2.

FIG. 32 is an exploded view of an alternative implementation of scope mounting component 24, again for use with scope housing 490 as in FIG. 31, which can be adjusted as described above. In this implementation, however, axis block 560 has an approximately flat surface on which tower block 562 is mounted, and tower block 562 similarly has an approximately flat surface on which C clamp 564 is mounted. As in FIGS. 25-31, male dovetail part 470 (FIG. 24) is part of axis block 560, while clamp arms 56 and 58 are parts of C clamp 564.

In this implementation, screw 570 extends through axis block 560 and into a threaded hole in tower block 562. If screw 570 is loosened, tower block 562 can be rotated a few degrees around an axis described below. Similarly, screw 580 extends through tower block 562 and into a threaded hole in C clamp 564. When screw 580 is loosened, C clamp 564 can similarly be rotated a few degrees around an axis described below. The facing mounting surfaces of blocks 560 and 562 and also of block 562 and C clamp 564 can have features as described below to limit the adjustment to an appropriate range, such as 5° in each direction from a central point. As described above in relation to FIG. 25, scope mounting component 24 implemented as in FIG. 32 can be dismounted from windage block 80 in the manner shown in FIG. 24 after screws 570 and 580 are tightened, and component 24 can be later remounted with the scope having the same position as before it was dismounted, allowing easy replacement of scopes without further adjustments as described above.

Figure 33:
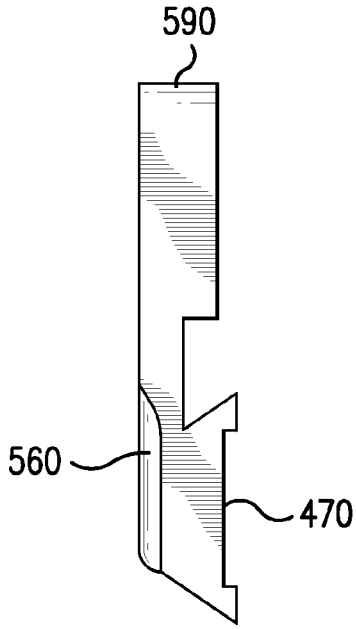
FIG. 33 is a side view of an axis block as in FIG. 32.
Figure 34:
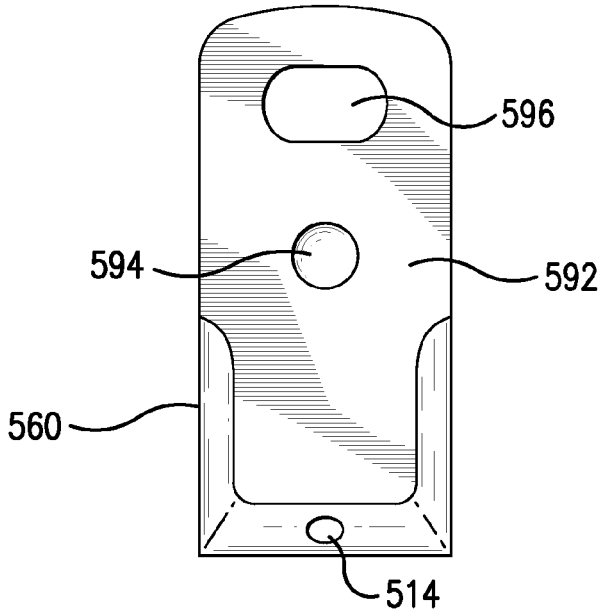
FIG. 34 is another side view of an axis block as in FIGS. 32-33.

FIG. 33 shows a side view of axis block 560, illustrating male dovetail part 470 at one end and mounting portion 590 at the other. FIG. 34 shows another side view of axis block 560 in which mounting surface 592 of mounting portion 590 is shown, as well as recess 514, as described above in relation to FIG. 27. Mounting surface 592 includes circular indentation 594 and elongated opening 596. Circular indentation 594 receives a counterpart circular knob on a facing mounting surface of tower block 562, as described below, while elongated opening 596 allows tower block 562 to be turned about an axis through circular indentation 594 when screw 570 is loosened. The axis through circular indentation 594 and approximately perpendicular to mounting surface 592 is sometimes referred to as the "second axis".

Figure 35:
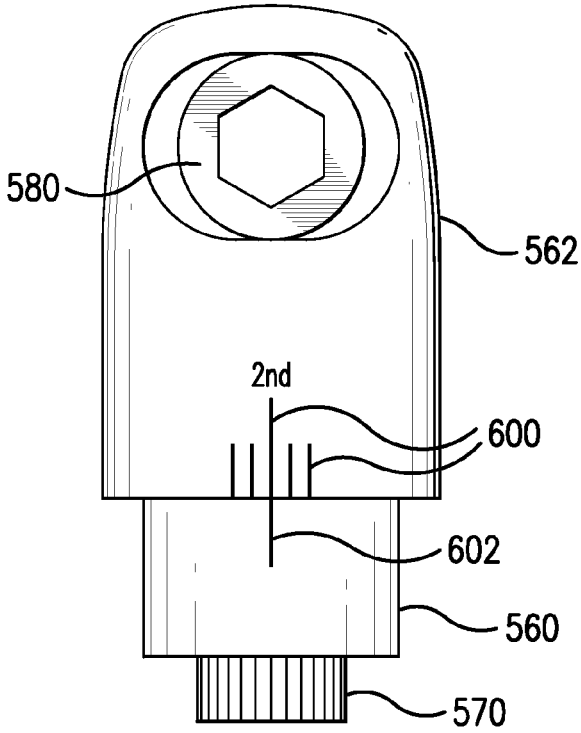
FIG. 35 is a top view of the connection between an axis block as in FIGS. 32-34 and a tower block as in FIG. 32.
Figure 36:
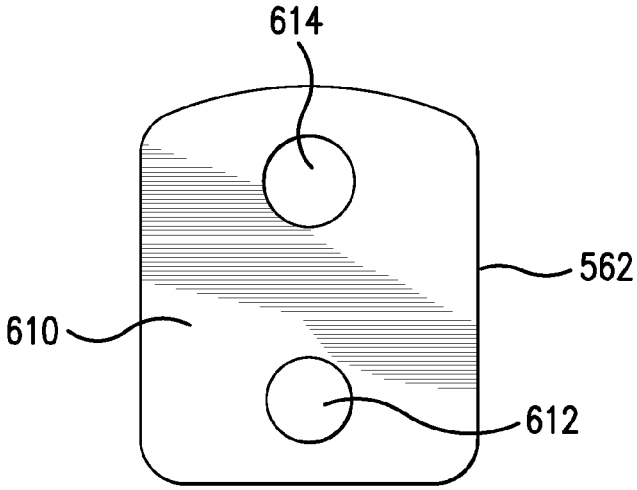
FIG. 36 is a side view of a tower block as in FIGS. 32 and 35.

These features can be understood more fully from FIG. 35, showing a top view of the connection between axis block 560 and tower block 562. As can be seen, the upper surface of tower block 562 is marked "2nd", referring to adjustment around the second axis mentioned above. In addition, markings 600 on tower block 562 can be aligned with marking 602 on axis block 560 to obtain a desired second axis adjustment. FIG. 36 shows the facing mounting surface 610 on tower block 562, with circular knob 612 also centered about the second axis and with threaded opening 614 for screw 570.

Figure 37:
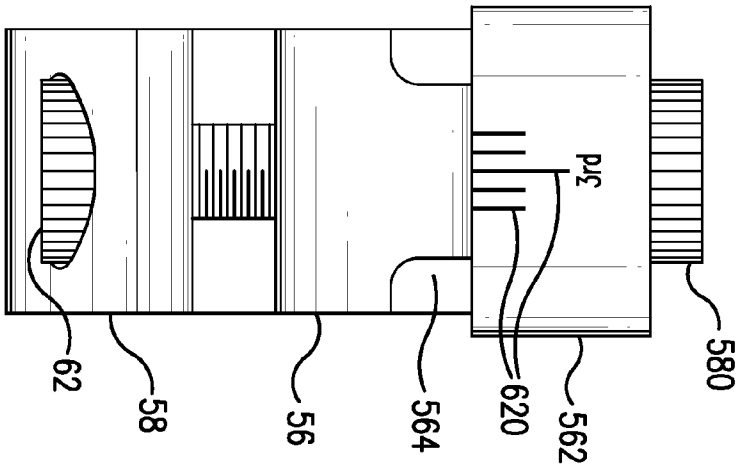
FIG. 37 is a side view of the connection between a tower block as in FIGS. 32, 35, and 36 and a tower block as in FIG. 32.
Figure 38:
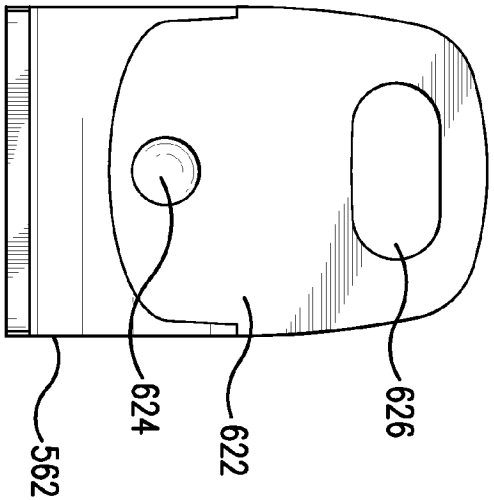
FIG. 38 is another side view of a tower block as in FIGS. 32 and 35-37.
Figure 39:
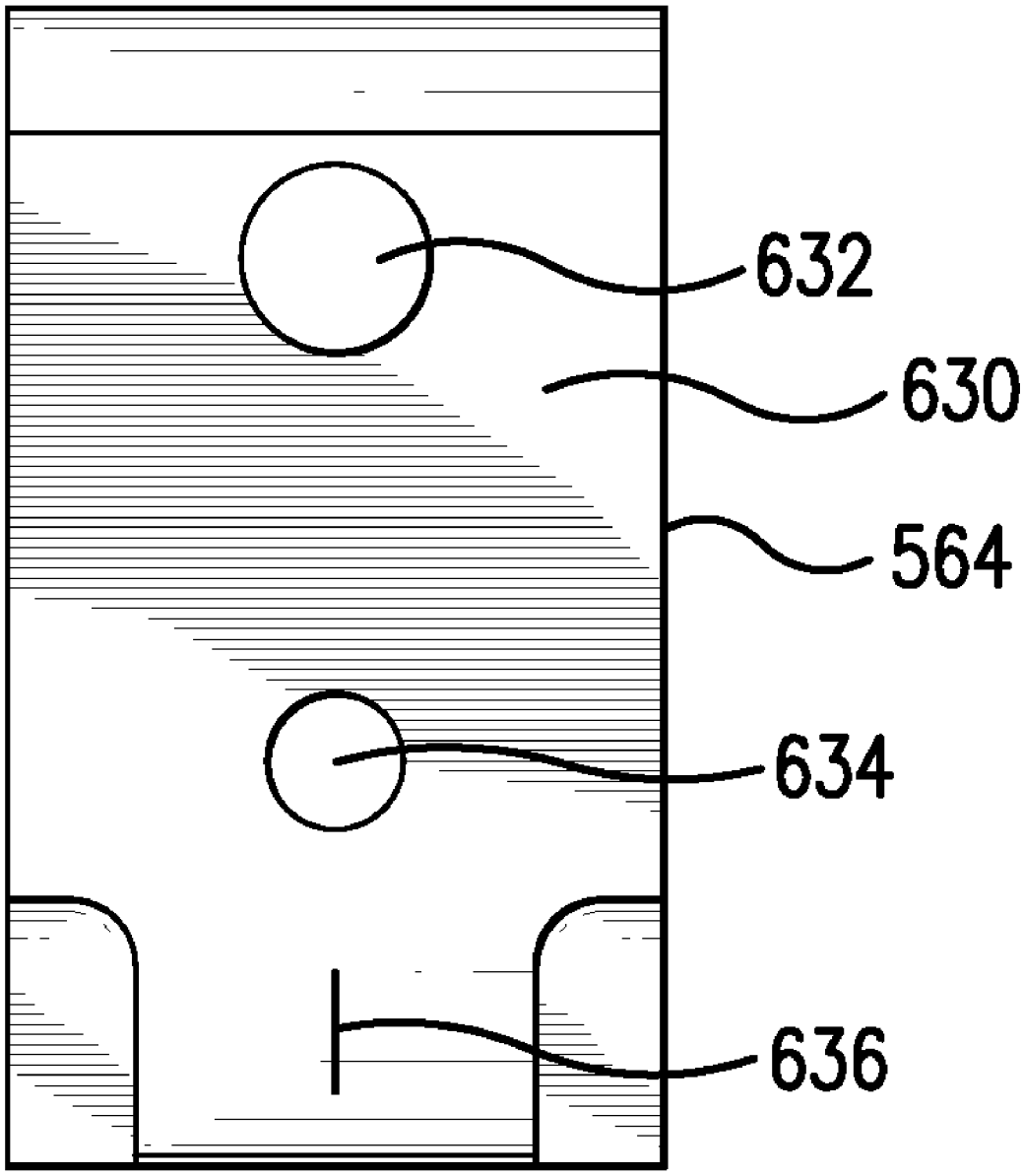
FIG. 39 is a side view of a C clamp as in FIGS. 32 and 37.

FIG. 37 shows a side view of tower block 562 and C clamp 564, similar to the view in FIG. 35. For adjustment around a third axis as described below, tower block 562 is marked "3rd" and has markings 620. FIG. 38 shows mounting surface 622 of tower block 562, with circular indentation 624 similar to circular indentation 594 in FIG. 34, but centered around the third axis, and with elongated opening 626 similar to elongated opening 596 in FIG. 34 to allow adjustment around the third axis by loosening screw 580. FIG. 39 shows facing mounting surface 630 of C clamp 564, with circular knob 632 similar to circular knob 612 in FIG. 36 but centered about the third axis, and with threaded opening 634 similar to threaded opening 614 to receive screw 580. In addition, marking 636 can be aligned with markings 620 (FIG. 37) to obtain a desired third axis adjustment.

As can be understood, tower block 562 is adjustably mountable on axis block 560, while C clamp 564 is adjustably mounted on tower block 562. As used in this context, the term "adjustably mountable" means that parts can be mounted in a way that allows adjustment of the relative positions of the mounted parts. The adjustable mountings described in relation to FIGS. 32-39 are examples of axial adjustments, which are more constrained and are therefore typically easier to make than the less constrained adjustments between axis block 492 and C clamp 494 described in relation to FIGS. 25-31, involving convex and concave mounting surfaces.

The techniques described above in relation to FIGS. 1-39 make it possible to support a scope, bowsight, or other viewing part on a bow with greater ease and precision of adjustment in several ways. Features of guide surfaces and support positions, including V-shaped guide surfaces and both fixed and adjustable gibs, help to provide automatic stability of an elevation block and a windage block support on the elevation block; stability is maintained despite pressure on a coarse adjustment thumb lever due to the effective spans of support positions being within a stable range as described above. The eight pairs of facing guide surfaces provide stable axial alignment in the elevation direction. The adjustable gibs, whether adjusted automatically or manually, such as by screws, allow a long period of consistent repeatable use despite normal wear of the gibs. The facing mounting surfaces of scope mounting components allow adjustment about second and third axes, either with convex and concave mounting surfaces or with separate second and third axis adjustments; in either case, an archer can remove and reattach the adjusted scope mounting component while maintaining the adjustment for a particular scope. The female and male dovetail parts that support the scope mounting component can be stably held in position with a lock screw and a mating indentation. Taper bushings also prevent slop and wear along the windage block guide pins, similarly allowing consistent pressure over a long period of use. A wave spring washer between the windage block and the elevation block helps by supplying consistent directional pressure between the taper bushings and the guide pins, while the nylon washer under the wave spring washer eliminates noise and wear as it slides across the elevation block surface.

The exemplary implementations described above are illustrated and have been successfully prototyped, tested, and produced with specific shapes, dimensions, materials and other characteristics, but the scope of the invention includes various other shapes, dimensions, materials and characteristics. For example, the particular shape of each of the parts could be different, and could be of appropriate sizes for any particular archer's preference. Furthermore, rather than being fabricated from separate parts or layers, including conventional machining techniques for smooth edges and so forth, the structures as described above could be manufactured in various other ways and could include various other materials. For example, some structures could be integrally formed, such as by molding metal or plastic material.

Similarly, the exemplary implementations described above include specific examples of elevation components and structures, scope mounting components, windage structures, support structures, bushing parts, mounting parts, and so forth, but any appropriate implementations of those components, structures, and parts could be employed. Further, the above exemplary implementations employ specific ways of supporting a scope, bowsight or other viewing part, but a wide variety of other ways could be used within the scope of the invention.

While the invention has been described in conjunction with specific exemplary implementations, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

The invention claimed is:

1. A device that can be part of archery apparatus that supports viewing parts on bows; the device comprising:

a support structure that, in use, is supported on a bow;

an elevation structure that, in use, supports a viewing part, the elevation structure being movable in an elevation direction relative to the support structure; the elevation structure having first and second opposite sides and, in use, receiving pressure in a direction approximately perpendicular to the elevation direction from the first side toward the second side; and first and second guide surface sets that are disposed toward the first and second sides of the elevation structure, respectively, and that each include one or more guide surface pairs; each guide surface pair including a respective guide surface on the support structure and a respective guide surface on the elevation structure; in use, each pair's respective guide surfaces sliding against each other in the elevation direction; each of the first and second guide surface sets having a respective effective span across which it is affected when the elevation structure receives pressure from the first side; the first set's effective span being within a stable range relative to the second set's effective span.

2. The device of claim 1 in which the viewing part is at least one of a scope, a bowsight, and an archery sight.

3. The device of claim 1 in which, in use, the elevation structure is movable in the elevation direction relative to the support structure to any of a range of positions, the first set's effective span being within a stable range relative to the second set's effective span in each position in the range.

4. The device of claim 1 in which the guide surfaces in each pair are capable of repeatedly sliding against each other in the elevation direction.

5. The device of claim 1 in which the elevation structure includes:

a control component that can be operated to control movement of the elevation structure in the elevation direction relative to the support structure; the control component including:

a pressure-responsive part that responds to pressure exerted by a user from the first side by moving in a pressing direction from the first side toward the second side and that responds when the user stops exerting pressure by moving back toward the first side.

6. The device of claim 5 in which the control component allows coarse adjustment of the elevation structure's position in the elevation direction when the user exerts pressure from the first side on the pressure-responsive part and also exerts pressure in the elevation direction on the elevation structure.

7. The device of claim 6 in which the control component further allows fine adjustment of the elevation structure's position in the elevation direction when the user does not exert pressure from the first side.

8. A device that can be part of archery apparatus that supports viewing parts on bows; the device comprising:

a support structure that, in use, is supported on a bow; the support structure including:

first and second outward faces that face outward approximately opposite each other; and an open space defined in the support structure, extending through the support structure between the first and second outward faces;

an elevation structure that, in use, supports a viewing part, the elevation structure being movable within the open space in an elevation direction relative to the support structure; and on the support structure and the elevation structure, first and second guide surface sets that are disposed toward the first and second outward faces of the support structure, respectively, and that each include at least one guide surface pair with a respective guide surface on the support structure and a respective guide surface on the elevation structure; in use, each pair's respective guide surfaces sliding against each other in the elevation direction;

in at least one of the guide surface pairs, one of the respective guide surfaces having an inward-extending surface and the other having an outward-extending surface, the inward- and outward-extending surfaces departing sufficiently from flat surfaces that, together, they allow only negligible relative movement between the support structure and the elevation structure in directions other than the elevation direction.

9. The device of claim 8 in which the inward- and outward-extending surfaces are V-shaped.

10. The device of claim 8 in which each of the first and second guide surface sets includes two guide surface pairs, the two pairs being opposite each other across the open space; in all of the guide surface pairs, one of the respective guide surfaces including an inward-extending surface and the other including an outward-extending surface.

11. The device of claim 10 in which each of the inward- and outward-extending surfaces includes two approximately planar subsurfaces that form a V-shape; the first and second guide surface sets together including eight of the approximately planar subsurfaces.

12. A device that can be part of archery apparatus that supports viewing parts on bows; the device comprising:

a support structure that, in use, is supported on a bow;

an elevation structure that, in use, supports a viewing part, the elevation structure being movable in an elevation direction relative to the support structure;

one or more guide surface pairs that includes a respective guide surface on the support structure and a respective guide surface on the elevation structure;

one or more gibs, each gib being between a respective one of the guide surface pairs with a first side disposed toward the pair's respective guide surface on the support structure and a second side disposed toward the pair's respective guide surface on the elevation structure, at least one of the first and second sides having a sliding surface that can slide against the guide surface toward which it is disposed; and for at least one of the gibs, a spring-like component that presses each sliding surface of the gib against the guide surface toward which it is disposed.

13. The device of claim 12 in which each gib is mounted at its second side on the respective pair's guide surface on the elevation structure.

14. The device of claim 13 in which the spring-like component is a spring that exerts pressure between the elevation structure and the gib's second side.

15. The device of claim 12 in which each gib has a length extending approximately parallel to the elevation direction and has a substantially square cross section along at least part of its length.

16. The device of claim 12 in which each gib's sliding surface and the guide surface toward which it is disposed are capable of repeatedly sliding against each other, the repeated sliding causing wear of the gib; the spring-like component maintaining approximately constant pressure in spite of the gib's wear.

17. A device that can be part of archery apparatus that supports viewing parts on bows; the device comprising:

a support structure that, in use, is supported on a bow; and a windage structure that, in use, supports a viewing part and is movable in a windage direction relative to the support structure;

the device further comprising one or both of:

at least one pin-like guide part that is supported on the support structure; the windage structure having one or more guide openings defined therein that are parallel and extend in approximately the windage direction; each of the at least one pin-like guide part extending through a respective one of the guide openings; at least one of the pin-like guide parts having thereon a respective set of one or more bushing parts that are between the guide part's outer surface and the respective guide opening's inner surface and that have inner surface capable of repeatedly sliding against the guide part's outer surface; at least one of the bushing parts having tapering diameter in the windage direction; and a spring-like component; the support structure having a guide surface that extends in the windage direction and the windage structure having a facing guide surface that faces the guide surface; the spring-like component being between the guide surface and the facing guide surface and pressing the windage structure away from the guide surface.

18. The device of claim 17 in which the device comprises the at least one pin-like guide part and, for at least one of the pin-like guide parts, both of the respective set of two bushing parts have tapering diameter in the windage direction.

19. The device of claim 18 in which the two bushing parts that have tapering diameter are positioned in the respective guide opening with their larger diameter ends disposed toward each other and with their smaller diameter ends disposed away from each other.

20. The device of claim 17 in which the device comprises the spring-like component and the spring-like component is a wave spring washer.

21. The device of claim 20 in which the guide surface and facing guide surface can become farther apart up to a limit, the wave spring washer providing approximately constant pressure as the guide surface and facing guide surface become farther apart up to the limit.

22. The device of claim 17 in which the device comprises the spring-like component and the facing guide surface has a recess defined therein, the spring-like component being in the recess.

23. The device of claim 22, further comprising:

between the guide surface and the spring-like component and in the recess, a sliding component that has a first side disposed toward the guide surface and a second side disposed toward the spring-like component, the first side having a sliding surface that can repeatedly slide against the guide surface, the sliding surface providing a sliding friction relative to the surface toward which it is disposed.

24. A device that can be part of archery apparatus that supports viewing parts on bows; the device comprising:

a support structure that, in use, is supported on a bow;

a windage structure that is supported on the support structure and is movable in a windage direction relative to the support structure, the windage structure including at least two female dovetail recesses, the dovetail recesses including first and second female dovetail recesses positioned so that a counterpart male dovetail component can be mounted and dismounted by sliding between the first and second female dovetail recesses;

first and second mounting parts, each having first and second ends; the first mounting part's first end having the male dovetail components that are removably mountable in the first and second female dovetail recesses of the windage structure; the second mounting part's first end being adjustably mountable on the first mounting part's second end allowing adjustment of the second mounting part's position relative to the first mounting part around a first axis; and a scope mounting part on which a viewing part can be mounted, the scope mounting part being adjustably mountable on the second mounting part's second end allowing adjustment of the scope mounting part's position relative to the first part around a second axis different than the first axis.

25. A device that can be part of archery apparatus that supports viewing parts on bows; the device comprising:

a support structure that, in use, is supported on a bow;

a windage structure that is supported on the support structure and is movable in a windage direction relative to the support structure, the windage structure including at least two female dovetail recesses, the dovetail recesses including first and second female dovetail recesses positioned so that a counterpart male dovetail component can be mounted and dismounted by sliding between the first and second female dovetail recesses; and user-operated windage adjustment components operable to move the windage structure in the windage direction;

the first and second female dovetail recesses being positioned so that the counterpart male dovetail component can be mounted and dismounted without affecting the windage adjustment components.

26. The device of claim 25, further comprising a first mounting part with a first end that includes the male dovetail component.

27. The device of claim 25, further comprising first and second mounting parts, each having first and second ends; the first mounting part's first end having the male dovetail component, the second mounting part's first end being adjustably mountable on the first mounting part's second end allowing adjustment of the second mounting part's position relative to the first mounting part around a first axis.

28. The device of claim 25, further comprising:

an elevation structure that is supported on the support structure and that is movable in an elevation direction relative to the support structure; and user-operated elevation adjustment components operable to move the elevation structure in the elevation direction;

the windage structure being supported on the elevation structure.

29. The device of claim 25, wherein the user-operated windage adjustment components include a knob that clicks as it is turned, and each click indicates an amount of movement in the windage direction.

* * * * *